US007455006B2

(12) United States Patent
Toth

(10) Patent No.: US 7,455,006 B2
(45) Date of Patent: Nov. 25, 2008

(54) MODULAR/CONFIGURABLE DIE FOR A ROTARY DIE CUTTER

(75) Inventor: Zsolt Toth, 132 Bella Vista St., Tuckahoe, NY (US) 10707

(73) Assignee: Zsolt Toth, Tuckahoe, NY (US)

( * ) Notice: Subject to any disclaimer, the term of this patent is extended or adjusted under 35 U.S.C. 154(b) by 0 days.

(21) Appl. No.: 10/700,448

(22) Filed: Nov. 5, 2003

(65) Prior Publication Data

US 2004/0089129 A1 May 13, 2004

Related U.S. Application Data

(60) Provisional application No. 60/423,604, filed on Nov. 5, 2002.

(51) Int. Cl.
*B26D 7/20* (2006.01)
*B26D 1/12* (2006.01)
*B21K 5/12* (2006.01)

(52) U.S. Cl. ..... 83/698.41; 83/331; 83/343; 83/663; 83/660; 83/698.51; 83/678; 76/107.1

(58) Field of Classification Search ..... 83/698.41, 83/698.51, 698.61, 346, 674, 663, 675, 699, 83/700, 620, 660, 695, 331, 678, 880, 673, 83/343, 659, 575; 76/107.8; 493/354, 63, 493/355, 367, 370, 372
See application file for complete search history.

(56) References Cited

U.S. PATENT DOCUMENTS 3,752,042 A * 8/1973 Castille ..... 493/471
4,020,724 A * 5/1977 Quinlan ..... 83/346
4,343,215 A * 8/1982 Fuchs ..... 83/670
5,027,509 A * 7/1991 Barben et al. ..... 29/895.3
5,111,725 A 5/1992 Simpson et al.
5,429,577 A * 7/1995 Simpson et al. ..... 493/354
5,515,749 A * 5/1996 Sandford ..... 76/107.1
5,875,699 A * 3/1999 Koelsch ..... 83/698.41
5,881,620 A 3/1999 Smithwick, Jr. et al.
6,467,682 B2 10/2002 Toth et al.
6,494,123 B2 * 12/2002 Fuchs ..... 83/698.51
6,644,153 B1 11/2003 Gordon
6,658,978 B1 * 12/2003 Johnson ..... 83/699.11
6,715,394 B2 * 4/2004 O'Dell et al. ..... 83/698.61
2002/0117026 A1 * 8/2002 Chang ..... 76/107.8

OTHER PUBLICATIONS

International Search Report; International Application No. PCT/US03/34923; International filing date: Nov. 5, 2003.

* cited by examiner

*Primary Examiner*—Ghassem Alie
(74) *Attorney, Agent, or Firm*—Antonelli, Terry, Stout & Kraus, LLP.

(57) ABSTRACT

A modular/configurable rotary die and a rotary die cutter (4) incorporating the die for making a corrugated carton blank (2) are disclosed. The rotary die comprises a plurality of die components (6,7,8) each having at least one blade (43-48) thereon for at least one of scoring, creasing and cutting a corrugated sheet (13) to cooperatively form a corrugated carton blank. With reference to the three dimensions of a carton (1) to be erected from the corrugated carton blank, the die components include at least one length die component (6), at least one height die component (7) and at least one width die component (8). By replacing at least some of the die components with different sizes/types of die components different sizes/types of carton blanks can be produced without requiring the use of dedicated rotary dies for each size/type of carton blank.

20 Claims, 18 Drawing Sheets

MODULAR/CONFIGURABLE DIE FOR A ROTARY DIE CUTTER

RELATED APPLICATION

This application claims priority under 35 U.S.C. §119 of provisional application No. 60/423,604 filed Nov. 5, 2002, the disclosure of which is incorporated herein by reference.

TECHNICAL FIELD

The present invention is a modular/configurable die for rotary die cutter equipment. This modular/configurable die enables the production of varying types and sizes of corrugated carton blanks eliminating the need for a dedicated die for each specific type/size blank. A dedicated die is one that contains different types of blades that are permanently mounted on the die in various positions and configurations. The blades cannot be changed and/or adjusted on the die. A different dedicated die—with its own unique type and/or configuration of blades—must be created to produce each specific type/size carton blank. As compared to the current methods used to produce corrugated carton blanks, the present invention provides unique flexibility and significant cost savings.

BACKGROUND

Currently, two methods are used to produce corrugated carton blanks—using a box machine or using a die cutter.

Broadly Defined:

A box machine crush-cuts corrugated material between adjustable discs that are mounted on rollers. By adjusting the discs, the material is processed to produce varying types and sizes of carton blanks.

A die cutter crush-cuts corrugated material between a die that is mounted on a press and an anvil. Using dedicated dies, the material is processed to produce varying types and sizes of carton blanks.

A box machine method to produce corrugated carton blanks will now be described.

Box machines can produce any size carton blanks for these standard corrugated cartons:

RSC—Regular Slotted Container
HSC—Half Slotted Container
FOL—Full Overlap Slotted Container
OSC—Overlap Slotted Container
OPF—One Piece Folder
FTD—Telescope Trays and Lids
5PF or FPF—5-panel Folders For the sake of brevity, only RSC will be mentioned specifically in herein. Unless otherwise noted, the comments about and descriptions of our invention apply to all of the above-listed cartons.

The steps to create above-named corrugated carton blanks using a box machine are:

1. A corrugated carton starts out as a stock sheet of corrugated material of a particular width and length.
2. The box machine performs the following functions on the sheet material to produce a carton blank that determines the type and size of a carton:
   Creasing to define the carton's length and width.
   Scoring to define the carton's height and to define the folding lines of the flaps.
   Slotting to separate the flaps and to create the manufactured joints used to glue the carton together.

3. Next the folder gluer equipment folds and glues the blank at the manufactured joint to create the knocked down flat (KDF). The folder gluer equipment can be attached to the box machine, or it can stand alone.
4. A KDF is shipped flat to the end-user where it is erected into a carton.

Box machine limitations include that a box machine can crease, score or slot only straight lines that are parallel to the length of the carton blank and perpendicular to the horizontal lines. A box machine cannot crease, score or slot straight lines that are angled; it cannot produce curved lines:

Angled and curved lines are used to produce specially designed cartons such as self-erecting, snap-bottom or other special-style cartons.

A box machine cannot produce a QuickBox™, a box having a continuous, quick closable closure panel as disclosed in commonly owned U.S. Pat. No. 6,467,682, that requires angles and curves.

A die-cutter method to produce corrugated carton blanks will now be described.

A die cutter can produce any size of above-named types of corrugated carton blanks, as well as virtually any type/size of specialty carton blank. A die cutter produces a specific type and size of carton blank. This carton blank can contain any combination of:

Straight lines that are horizontal and perpendicular
Straight lines that are angled
Curved lines A die is a component of die cutter equipment. The die is mounted on a roller in a rotary press. The die creases, scores, and slots stock sheet material when the material is fed between a die and an anvil to produce the carton blank. The steps to create the above-named corrugated carton blanks using a die cutter using the die-cutting method are the same as described above for the box machine.

There are two methods of using die cutters to produce carton blanks:

Flat die cutter: Uses a flat die in a flat press. This type of die cutter is used to produce carton blanks for specialty-type cartons and/or for short production runs. It cannot operate at high speed. To produce a different type/size carton blank, the first die must be removed and another die must be installed. This type of die cutter rarely will be used to produce QuickBox type boxes because they can be mass-produced at high-speed production using rotary die cutters.

Rotary die cutter: Uses a cylindrical die fitted around a roller in a rotary press. This type of die cutter produces any type/size of carton blanks using high-speed production. To produce a specific type or size of carton blank that will become a particular type or size carton—such as a full overlap slotted container versus a regular slotted container—a dedicated die for that type/size of carton blank must be mounted on the roller of the rotary die cutter. To produce a different type/size carton blank, the first die must be removed and another dedicated die must be mounted.

Today, all rotary die cutters for the corrugated carton industry use a dedicated die that cannot be adjusted to produce varying sized carton blanks and/or varying types of carton blanks that have special characteristics such as special folding patterns, with or without flaps, etc.

For Example:

To produce carton blank A in size 1, dedicated die #1 must be used for that type/size blank.

To produce carton blank A in size 2, dedicated die #2 must be used for that type/size blank.

To produce carton blank B in size 1, dedicated die #3 must be used for that type/size blank.

SUMMARY OF INVENTION

The present invention is a modular/configurable rotary die that enables the production of varying types and/or sizes of carton blanks eliminating the need for a die that is dedicated to create a specific type and/or size of carton blank. The modular/configurable rotary die is comprised of individual die components that are mounted directly on the roller of a standard rotary die cutter. There are three dimensions to a carton; therefore, our modular/configurable rotary die of the invention utilizes three basic die component types to produce carton blanks:

Length die-component

Height die-component

Width die-component

Utilizing varying sizes of these die components produces varying sizes of carton blanks.

Utilizing varying types of the width die-component produces varying types of carton blanks.

These individual die components are positioned and secured anywhere on the roller of a rotary die cutter utilizing positioning clamps of the invention:

These positioning clamps screw into the roller's existing, standard, threaded mounting holes.

The individual die components interlock to assure accurate positioning and alignment with each other on the roller.

This modularity and configurability is a breakthrough in making dies for the corrugated carton industry. On conventional dies, specific blades are permanently mounted in a specific configuration to produce a specific type and size of carton blank. These blades cannot be changed and/or adjusted on the die to produce a different type/size blank. Instead, a different dedicated die—with its own unique type and/or configuration of blades—must be created to produce another specific type/size carton blank. The present invention avoids these disadvantages associated with the use of conventional dedicated dies.

These features and advantages of the invention will become more apparent from the following detailed description of example embodiments of the invention taken with the accompanying drawings.

BRIEF DESCRIPTION OF DRAWINGS

FIGS. 18A, 18B, 18C, 18D, 18E and 18F illustrate respective steps and apparatus used in combining modular die components of the modular/configurable rotary die of the invention in multiple configurations for multiple box sizes wherein:

FIG. 18A depicts an assembly work station having a curved assembly surface on which the plurality of die components can be assembled and having a modular die component storage beneath the curved assembly surface;

FIG. 18B shows the assembly work station of FIG. 18A wherein a brace as shown in FIG. 18F is attached to the assembled modular die components;

FIG. 18C depicts the brace upon which the assembled modular die components are transported from the assembly work station to the rotary die;

FIG. 18D depicts the modular die components which have been transported and fastened to the roller of the rotary die cutter using the brace.

FIG. 18E illustrates the rotary die on the roller like that in FIG. 18D but with the brace removed; and FIG. 18F shows the brace with quick couplings whose position is adjustable on the brace for aligning, interlocking and transporting the modular die components in the proper configuration for the selected one of the multiple configurations for multiple box sizes.

DETAILED DESCRIPTION OF DISCLOSED EMBODIMENTS

Figure 1:
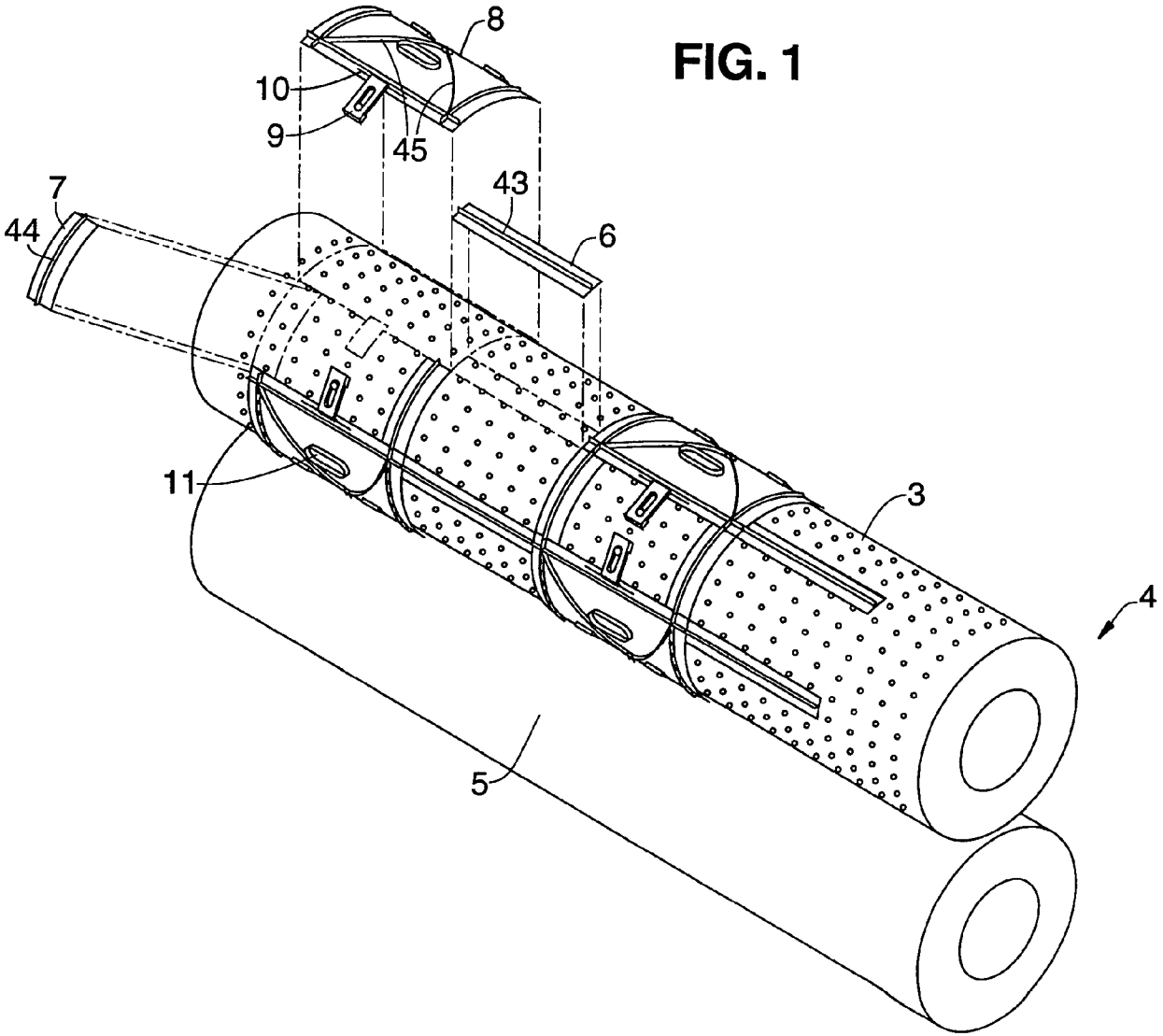
FIG. 1 is a perspective view of a modular/configurable rotary die according to a first embodiment of the invention with twelve modular die components several of which are shown in detached relation to the die roller of the rotary die, which modular die components can be combined in multiple configurations as the die roller for producing multiple box sizes.

The modular/configurable rotary die of the example embodiments utilize two different die models to produce carton blanks:

Rule-Model Approach

The die components used in the rotary die with this approach include:

Score rule die component that determines the length of a carton (for RSC and all types of QuickBox boxes)

Four (4) score rule die components are on each die.

Each score rule die component has one (1) blade.

Crease rule die component that determines the height of a carton (for RSC and all types of QuickBox boxes)

Four (4) crease rule die components are on each die.

Each crease rule die component has one (1) blade.

Flap die component that determines the width of a carton and cuts the slots for flaps (for RSC and QuickBox ✓ type boxes)

For RSCs, four (1) flap die components are on each die.

For QuickBox ✓, two (2) flap die components are on each die.

Each flap die component has multiple blades.

QuickBox closure panel die component that determines the width of a carton container and creates the QuickBox closure panel (for all types of QuickBox boxes)

For QuickBox, four (4)QuickBox closure panel die components are on each die.

For QuickBox ✓, two (2) QuickBox closure panel die components are on each die.

Each QuickBox closure panel die component has multiple blades.

Panel-Model Approach

The die components used in this approach include:

Score/crease panel die component that determines the length and height of a carton (for RSC and all types of QuickBox boxes)

Two (2) score/crease panel die components are on each die.

Each score/crease panel die component has four blades: Two (2) blades define the height of a carton and two (2) define the length.

Crease rule die component that determines the height of a carton (for RSC and all types QuickBox boxes)

One (1) crease rule die component is on each die.

Each crease rule die component has one (1) blade.

Flap die component that determines the width of a carton and cuts the slots for flaps (for RSC and QuickBox ✓ type boxes)

For RSCs, four (4) flap die components are on each die.

For QuickBox ✓, two (2) flap die components are on each die.

Each flap die component has multiple blades.

QuickBox closure panel die component that determines the width of a carton container and creates the QuickBox closure panel (for all types of QuickBox boxes)

For QuickBox, four (4) QuickBox closure panel die components are on each die.

For QuickBox ✓, two (2) QuickBox closure panel die components are on each die.

Each QuickBox closure panel die component has multiple blades.

EAXMPLES OF MODULARITY AND CONFIRURABLIITY

The modular/configurable rotary die of the invention produces carton blanks for varying types of QuickBox boxes as well as carton blanks for standard corrugated cartons such as a regular slotted container (RSC) type boxes.

Below are examples of two (2) different sizes of QuickBox boxes and RSCs—a total of four (4) different sized cartons—using one (1) modular/configurable rotary die.

Figure 2B:
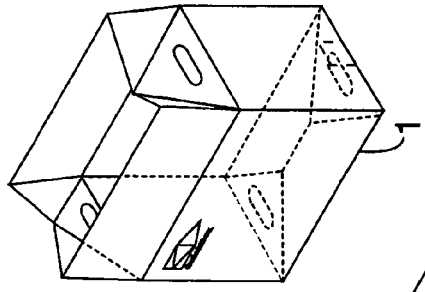
FIG. 2B is a perspective view of a corrugated box with a hide away handles below a continuous closure panel erected from the carton blank produced using the rotary die of FIGS. 1 and 2A.
Figure 2A:
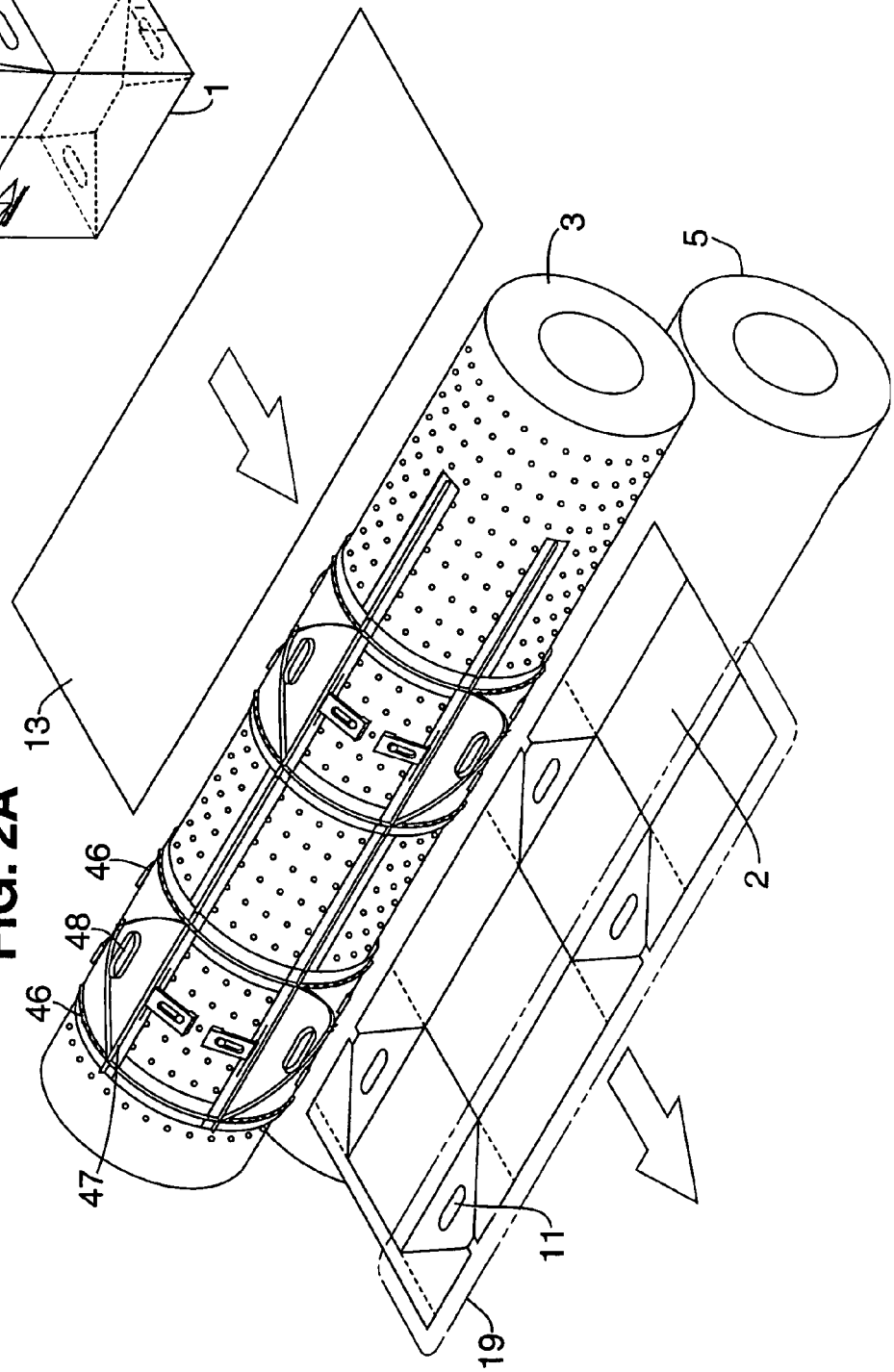
FIG. 2A is a perspective view of the modular/configurable rotary die of FIG. 1 in use for producing a corrugated carton blank from a corrugated sheet; the corrugated box referred to as QuickBox, to be erected from the carton blank having a continuous quick closable closure panel in accordance with commonly owned U.S. Pat. No. 6,467,682.
Figure 17B:
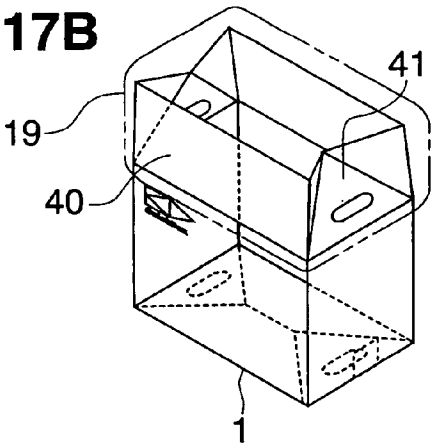
FIG. 17B is a perspective view of a box having a quick closable continuous closure panel erected form the carton blank of FIG. 17A.
Figure 17A:
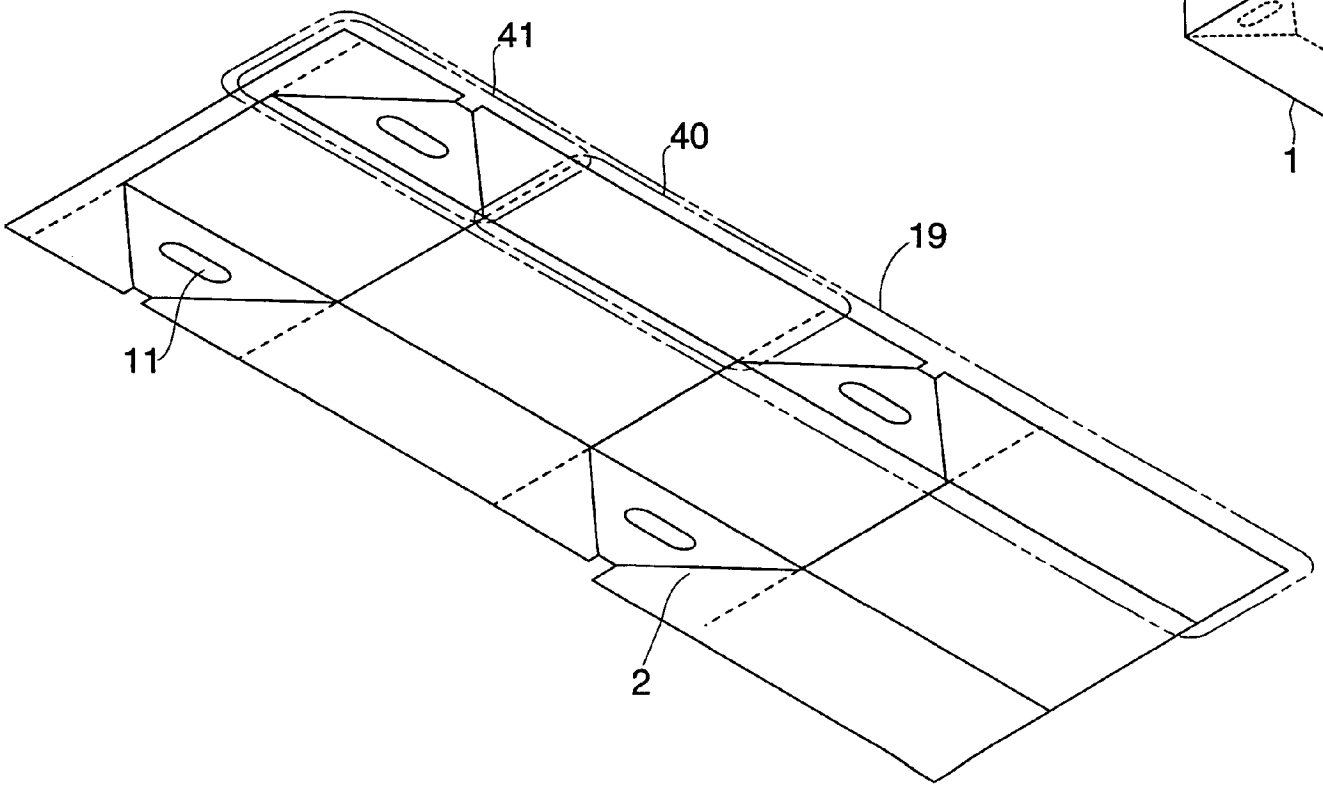
FIG. 17A is a perspective view of a carton blank for erecting the box of FIG. 17B having a quick closable closure panel with hide away handles using a rotary die of the invention.

A QuickBox box 1, FIG. 2B and FIG. 17B, is made from an erected carton, blank 2 produced from corrugated sheet 13, FIG. 2A, using the modular/configurable rotary die, FIGS. 1 and 2A, of the invention. The box 1 erected from the carton blank 2 has two continuous quick closable closure panels 19 that include four fold-in panels 41 and four top panels as well as two hide away handles 11 as discussed below.

Rule-Model Approach for Producing QuickBox Boxes

Example R1

QuickBox (Top and Bottom QuickBox Continuous Closure Panels)

To produce a carton blank 2 that is 12 inches long×12 inches high×12 inches wide, the die components listed below are mounted, interlocked and secured on the roller 3 of the rotary die cutter 4 shown in FIGS. 1 and 2A. The die components are interlocked with respect to one another by, for example, using pins on one of adjacent die elements and sockets or holes for receiving the pins on the other adjacent die element. A standard rotary die anvil roller 5 is opposite the roller 3 to form a rotary press of the die cutter.

Four (4) score rule die components 6, RL12 (determines 12-in. length)

Four (4) crease rule die components 7, RH12 (determines 12-in. height)

Four (4) QuickBox closure panel die components 8, RPW12 (determines 12-in. width)

The modular die components 6, 7 and 8 can be combined in multiple configurations for multiple box sizes using the twelve die components and twelve die mounting clamps 9. The score rule die components 6 key into/under die component 8. This rule-model approach provides good flexibility on length/height and employs inexpensive components although there are twelve components to install.

The clamps 9 are received in die mounting clamp slots 10 in the die components 6, 7 and 8, conventional threaded fasteners extend through slots in the clamps for receipt in threaded openings in the die roller 3. A hide away handle 11 is formed in the blank 2 and box 1 as discussed hereinafter.

Example R2

QuickBox ✓ (Top QuickBox Continuous Closure Panel and Bottom RSC Flaps)

Figure 5:
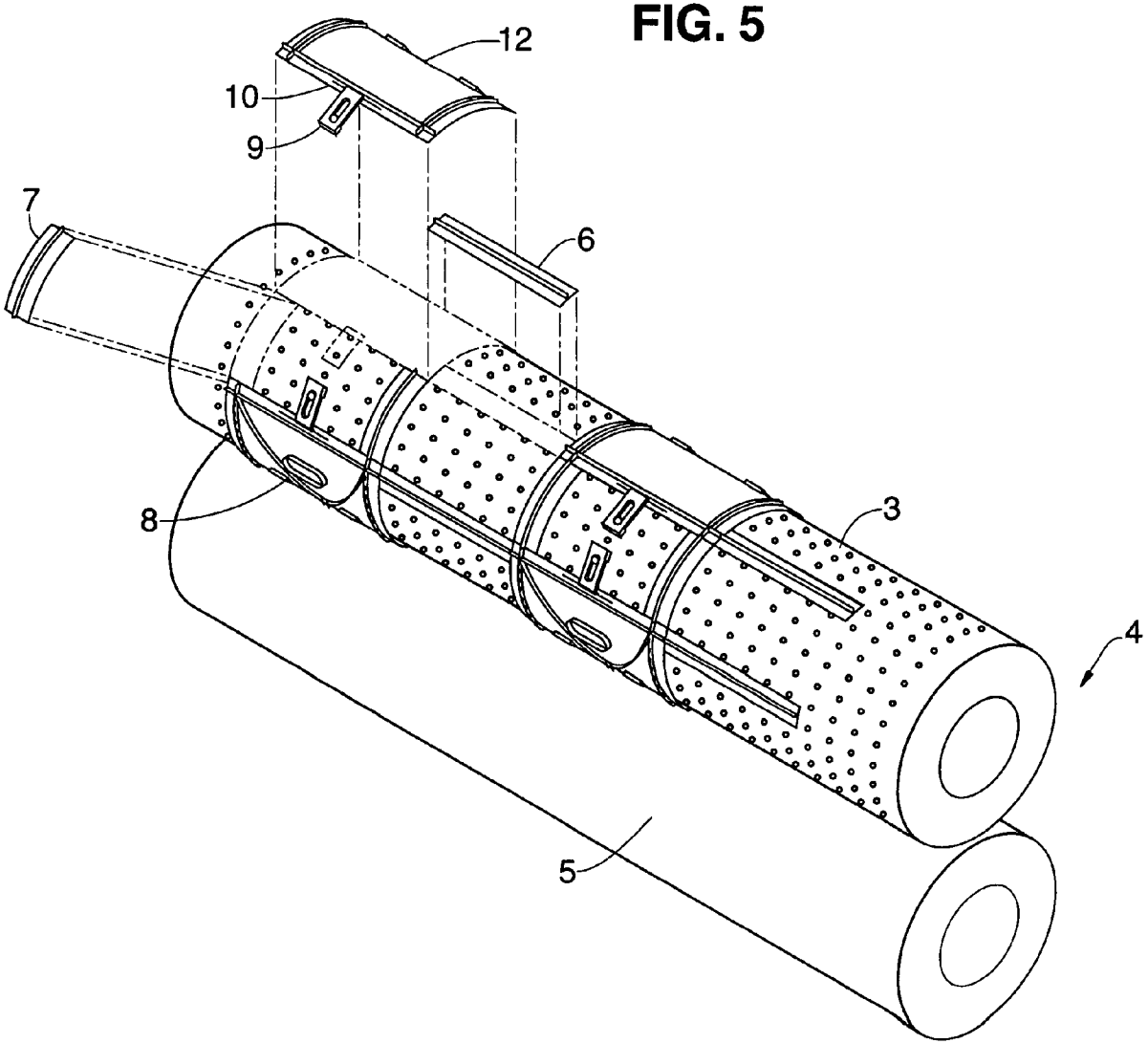
FIG. 5 is a perspective view of a modular/configurable rotary die of a third embodiment of the invention using twelve die components for producing a carton blank for a box having a regular slotted container flap as well as a quick closable closure panel.
Figure 6B:
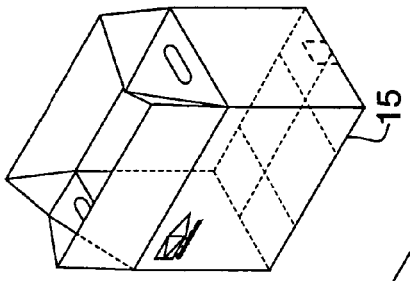
FIG. 6B is a perspective view of a corrugated box made by erecting the carton blank produced by the method and apparatus depicted in FIGS. 5 and 6A.
Figure 6A:
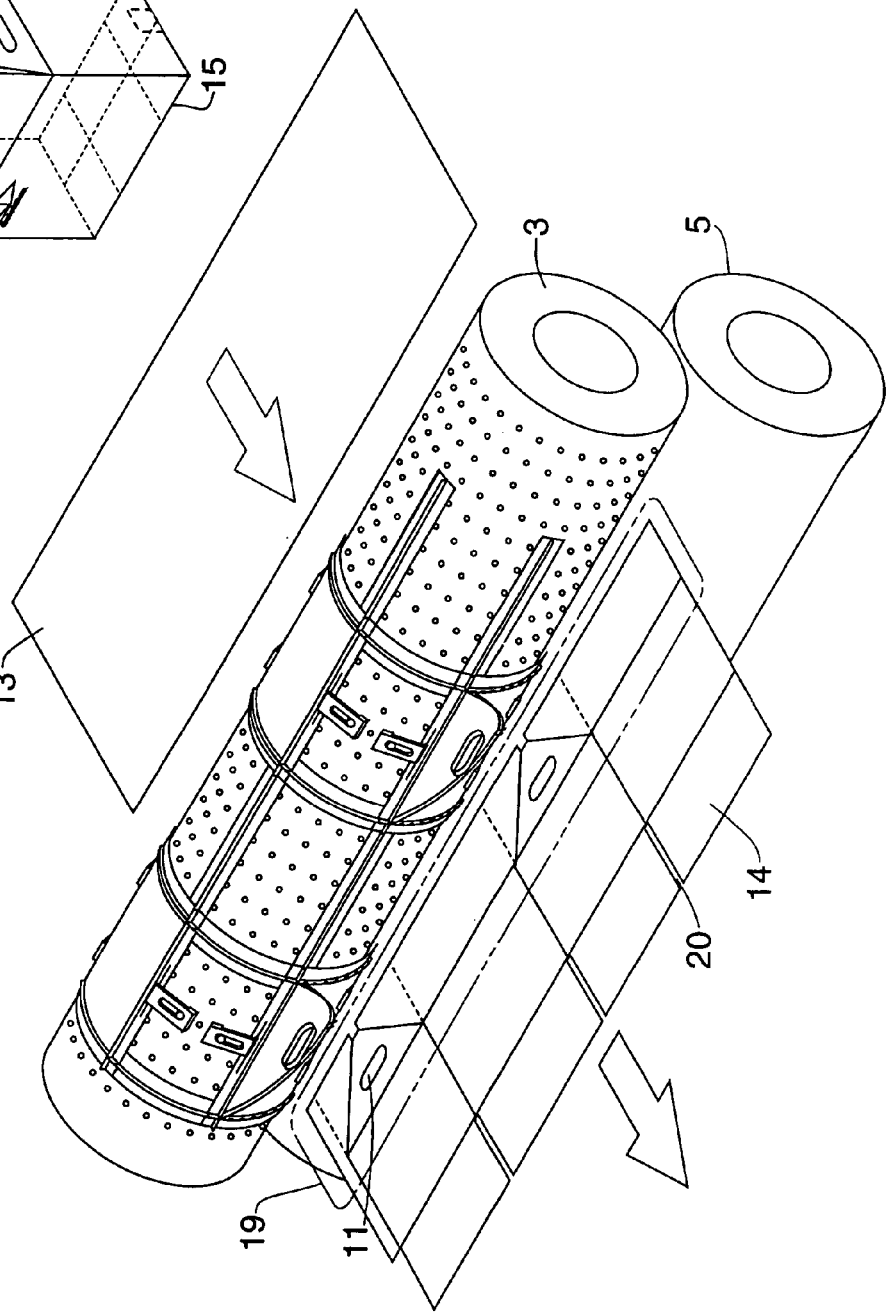
FIG. 6A is a perspective view of the modular/configurable rotary die of FIG. 5 in use for producing a corrugated carton blank for a box from a corrugated sheet.

To produce a carton blank 14, FIG. 6A, for box 15, FIG. 6B, that is 12 inches long×12 inches high×12 inches wide, these die components are mounted, interlocked and secured on the roller 3 of the rotary die cutter as shown in FIGS. 5 and 6A.:

Four (4) score rule die components 6, RL12 (determines 12-in. length)

Four (4) crease rule die components 7, RH12 (determines 12-in. height)

Two (2) QuickBox closure panel die components 8, RPW12 (determines QuickBox top 12-in. width)

Two (2) flap die components 12, RFW12 (determines RSC bottom 12-in. width)

Panel-Model Approach for QuickBox

Example P1

QuickBox (Top and Bottom QuickBox Continuous Closure Panels)

Figure 3:
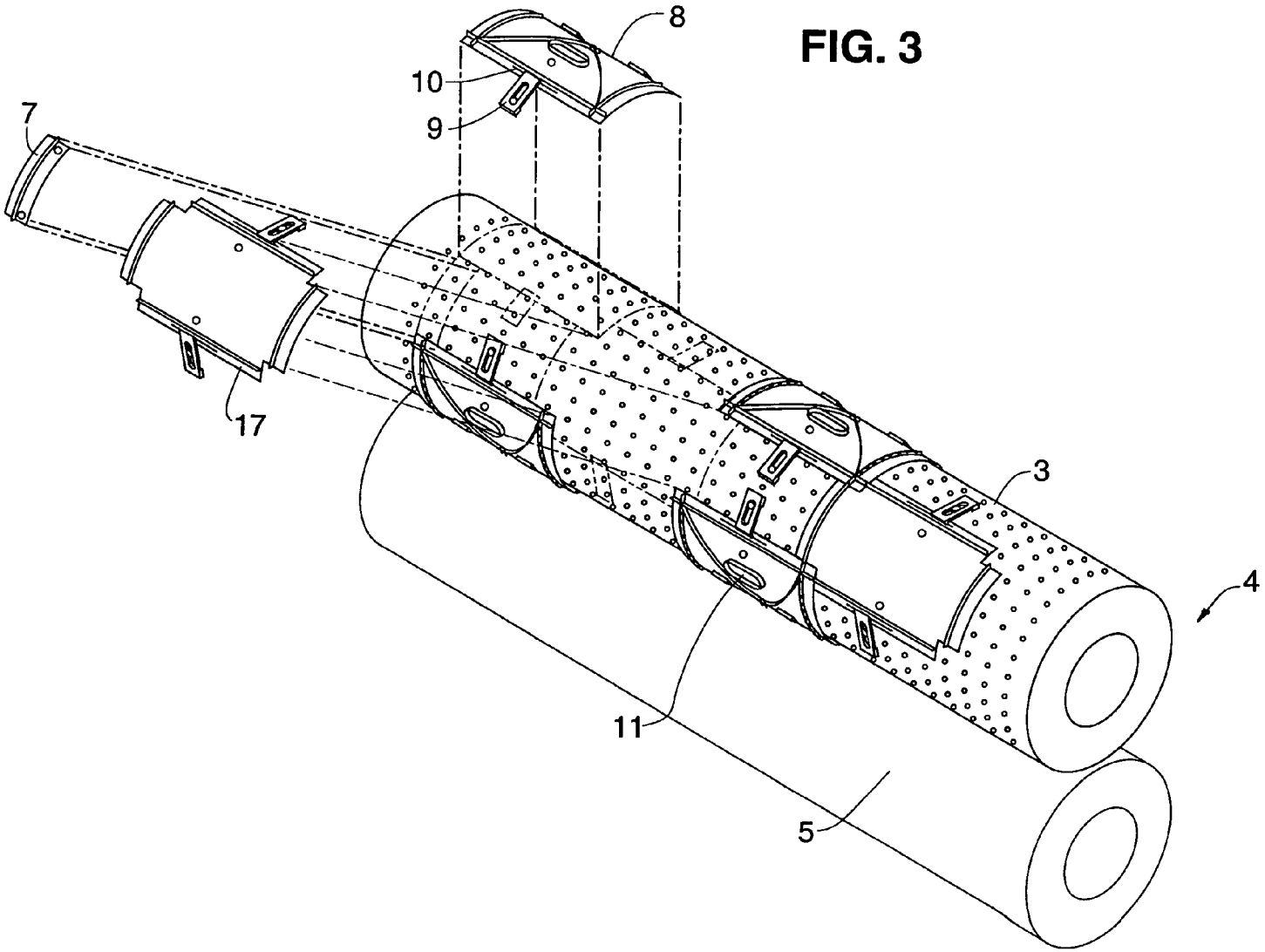
FIG. 3 is a perspective view, like FIG. 1, of a modular/configurable rotary die of a second embodiment of the invention employing seven die components.
Figures 4A, 4B:
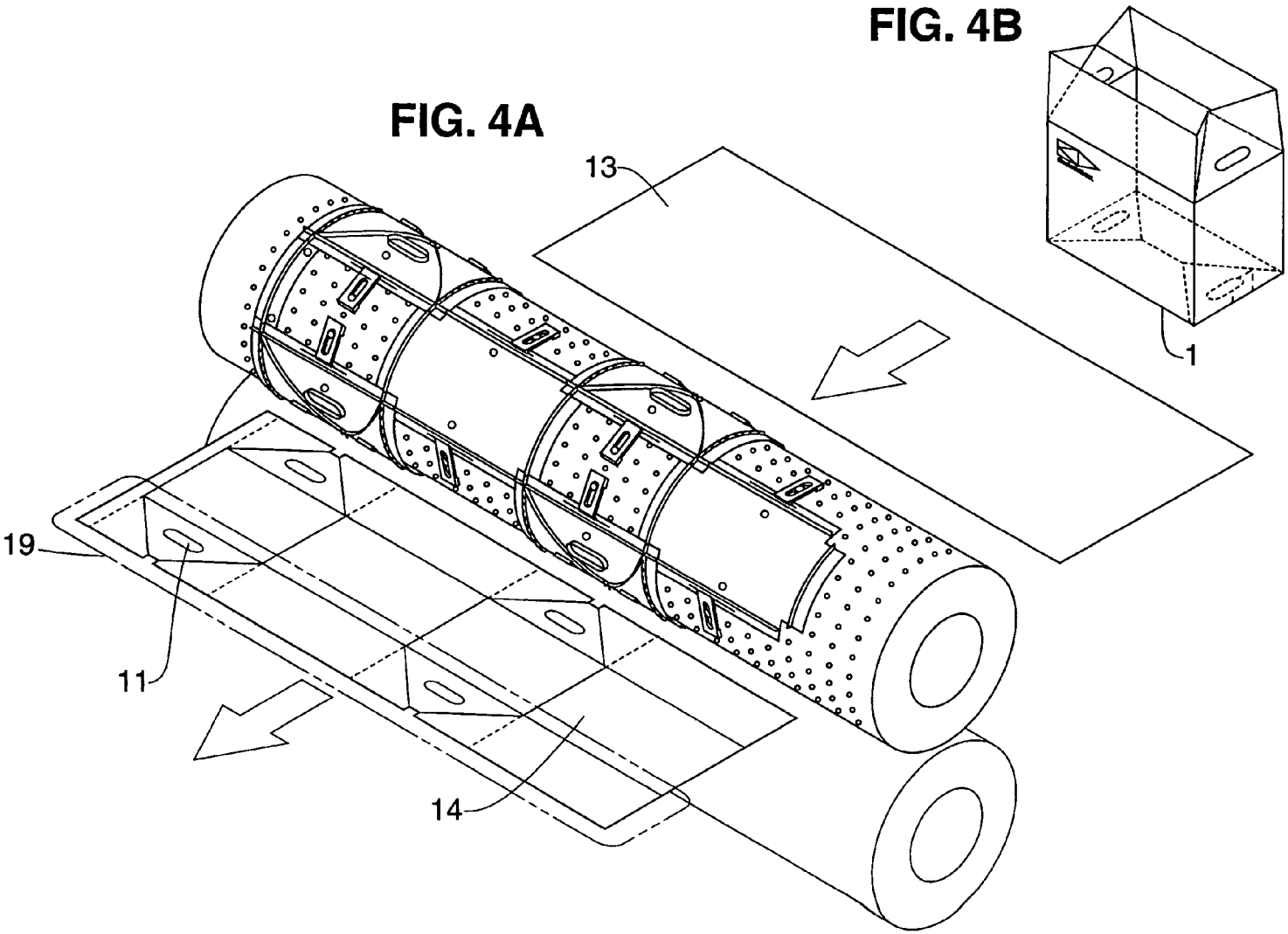
FIG. 4A is a perspective view of the modular/configurable rotary die of FIG. 3 in use for producing a corrugated carton blank, from a corrugated sheet, which blank can be erected to form a box having a quick closable closure panel.
FIG. 4B is a perspective view of a corrugated box with hide away handles and a continuous closure panel made by the process and apparatus in FIGS. 3 and 4A.

To produce a carton blank 14, FIG. 4A, that is 12 inches long×12 inches high×12 inches wide, these die components are mounted, interlocked and secured on the roller of the rotary die cutter as shown in FIGS. 3 and 4A:

Two (2) score/crease panel die components 17, PL1212 (determines 12-in. length and 12-in. height)

One (1) crease rule die component 7, RH12 (determines 12-in. height)

Four (4) QuickBox closure panel die components 8, RPW12 (determines 12-in. width)

The modular die components in this example, as in the other examples can be combined in multiple configurations for multiple box sizes. This approach uses seven die components and sixteen clamps 9. The height/length die components key into/under die components 8. This rotary die cutter has fewer parts and is easier to install. The length/height components are inexpensive but there is limited flexibility.

Example P2

QuickBox ✓ (Top QuickBox Continuous Closure Panel and Bottom RSC Flaps)

Figure 7:
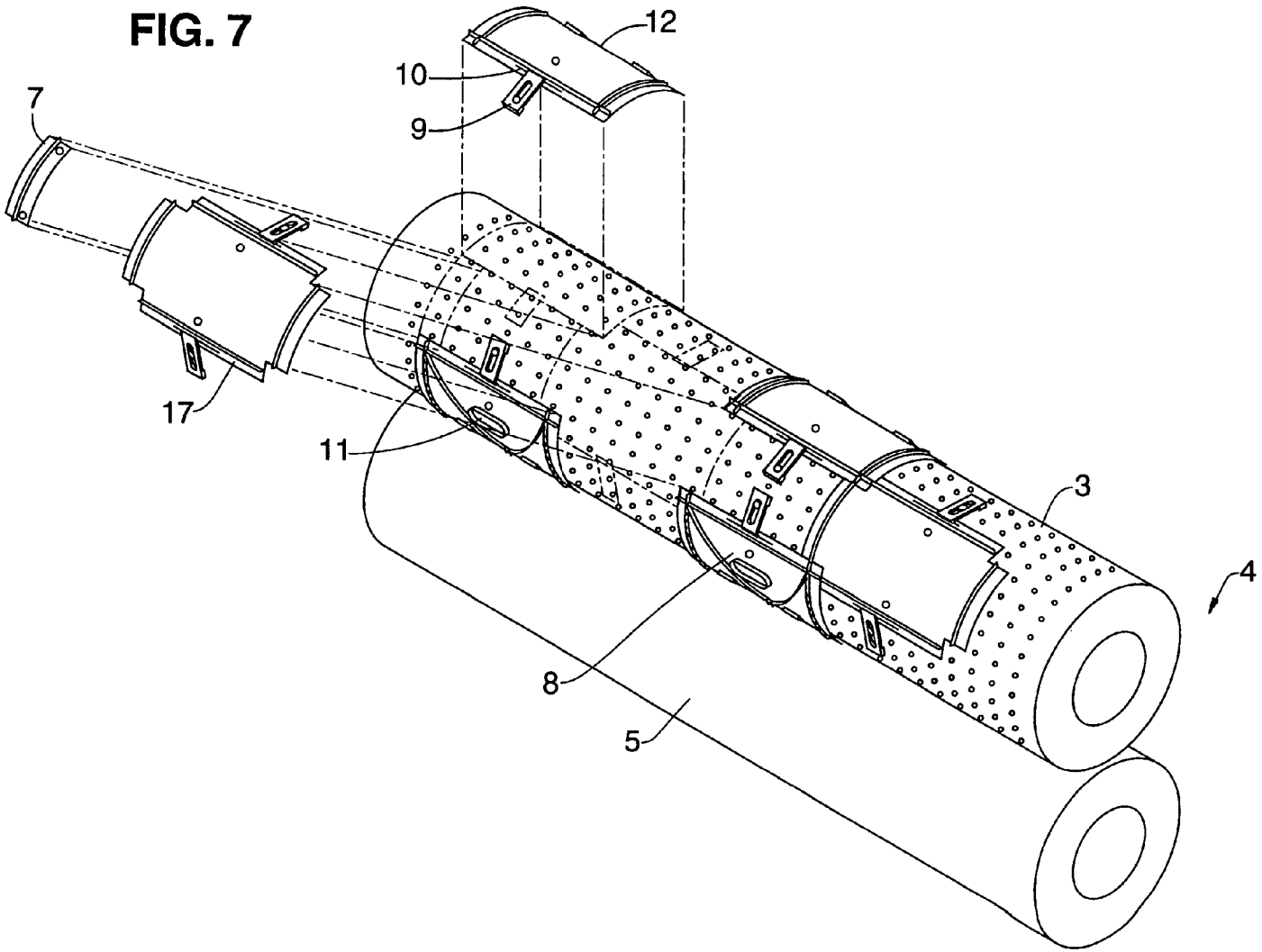
FIG. 7 is a perspective view of a fourth embodiment of a modular/configurable rotary die of the invention using seven die components for producing a carton blank for erecting a box having a regular slotted container flap as well as a quick closable closure panel.
Figures 8A, 8B:
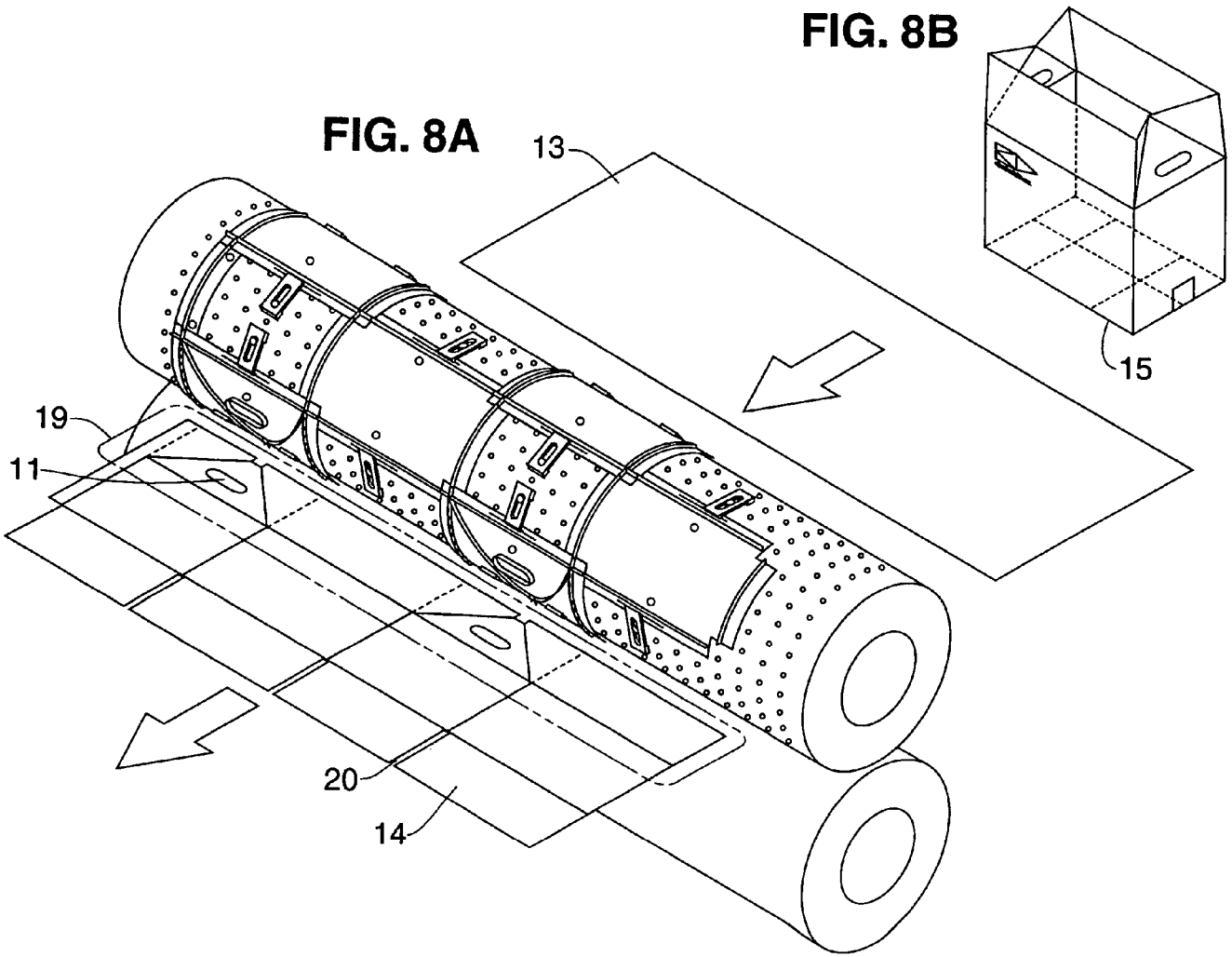
FIG. 8A is a perspective view of the rotary die of FIG. 7 in use for producing a carton blank for erecting the box shown in FIG. 8B.
FIG. 8B is a perspective view of a box erected from the carton blank made using the method and rotary die of FIGS. 7 and 8A.

To produce a carton blank 16 that is 12 inches long×12 inches high×12 inches wide, these die components are mounted, interlocked and secured on the roller 3 of the rotary die cutter 4 as shown in FIGS. 7 and 8A:

Two (2) score/crease panel die components 17, PL1212 (determines 12-in. length and 12-in. height)

One (1) crease rule die component 7, RH12 (determines 12-in. height)

Two (2) QuickBox closure panel die components 8, RPW12 (determines QuickBox top12-in. width)

Two (2) flap die components 12, RFW12 (determines RSC bottom12-in. width)

The box 15 erected from the carton blank 16 is shown in FIG. 8B.

Figure 12B:
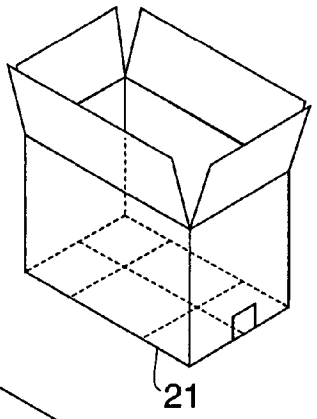
FIG. 12B is a perspective view of the corrugated box erected from the carton blank made with the apparatus and according to the method of FIGS. 11 and 12A.
Figure 14B:
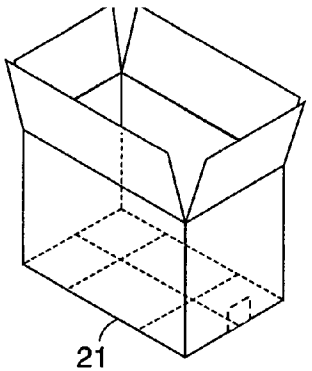
FIG. 14B is a perspective view of the box erected from a carton blank made using the method and rotary die illustrated in FIGS. 13 and 14A.

A regular slotted container (RSC) 21 shown in FIGS. 12B and 14B can be produced from carton blank 22, FIGS. 12A and 14A, made according to either the rule-model approach or the panel-model approach as described below.

Rule-Model Approach for RSC

Example R3

Regular Slotted Container

Figure 11:
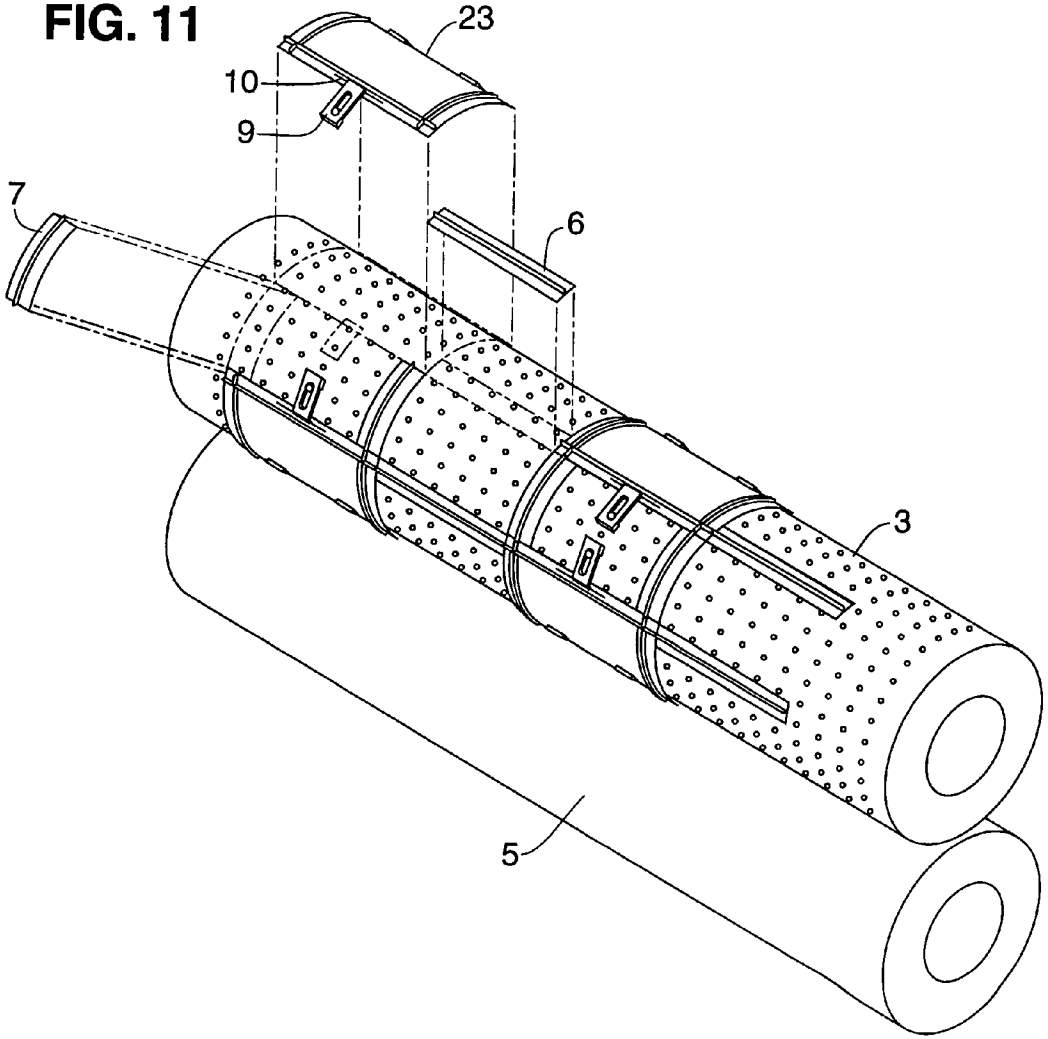
FIG. 11 is a perspective view of a sixth embodiment of a modular/configurable rotary die of the invention comprising twelve die components mounted on a rotary die which die components can be combined in multiple configuration for multiple box sizes, to produce carton blanks for erecting regular slotted container type boxes as shown in FIG. 12B.
Figure 12A:
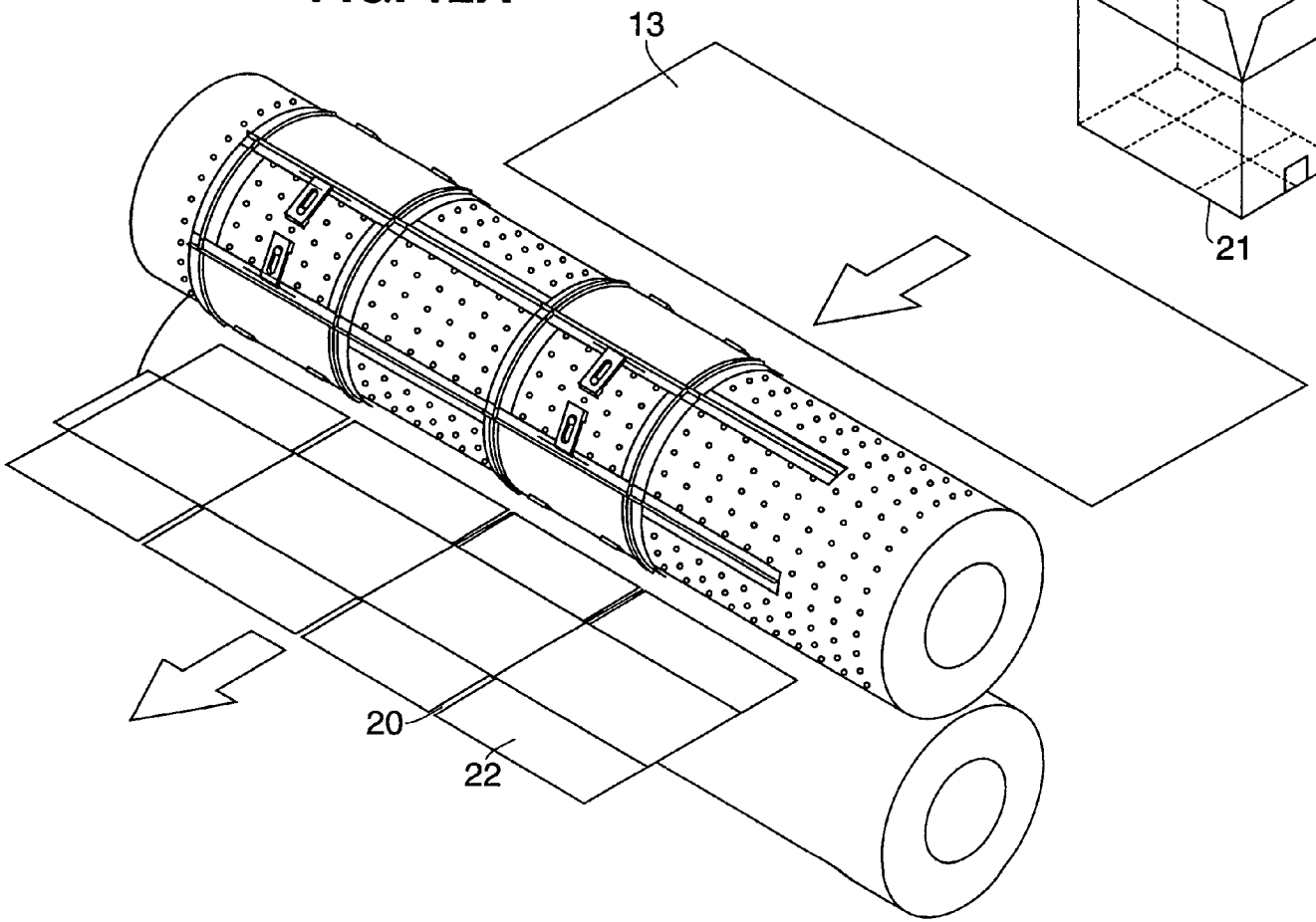
FIG. 12A is a perspective view of the rotary die of FIG. 11 in use for making carton blanks from corrugated sheets.

To produce an RSC carton blank 22 that is 12 inches long×12 inches high×12 inches wide, these die components are mounted, interlocked and secured on the roller of the rotary die cutter as shown in FIGS. 11-12A:

Four (4) length score rule die components 6, RL12 (determines 12-in. length)

Four (4) crease rule die components 7, RH12 (determines 12-in. height)

Four (4) flap die components 23, RFW12 (determines 12-in. width)

Example R4

Regular Slotted Container

To produce an RSC carton blank 22 that is 12 inches long×18 inches height×12 inches wide, these die components are mounted, interlocked and secured on the roller of the rotary die cutter as shown in FIGS. 11-12A:

Four (4) score rule die components 6, RL12 (determines 12-in. length)

Four (4) crease rule die components 7, RH18 (determines 18-in. height)

Four (4) flap die components 23, RFW12 (determines 12-in. width)

Reference is made to FIGS. 11 and 12A in both of the examples R3 and R4 wherein the die components are the same except for the crease ruler die components which are 12 inches in length in example R3 and 18 inches in length in example R4 (that length actually being shown in the drawings). From the examples it can be seen that the modular die components can be combined in multiple configurations for multiple box sizes. This rule-model approach uses twelve die components and twelve clamps. The score rule die components 7 key into/under the flap die components 23. The rule-model approach provides good flexibility on length/height and uses inexpensive components, although it is necessary to install twelve components on the roller 3 of the rotary die cutter 4.

Panel-Model Approach for RSC

Example P3

Regular Slotted Container

Figure 13:
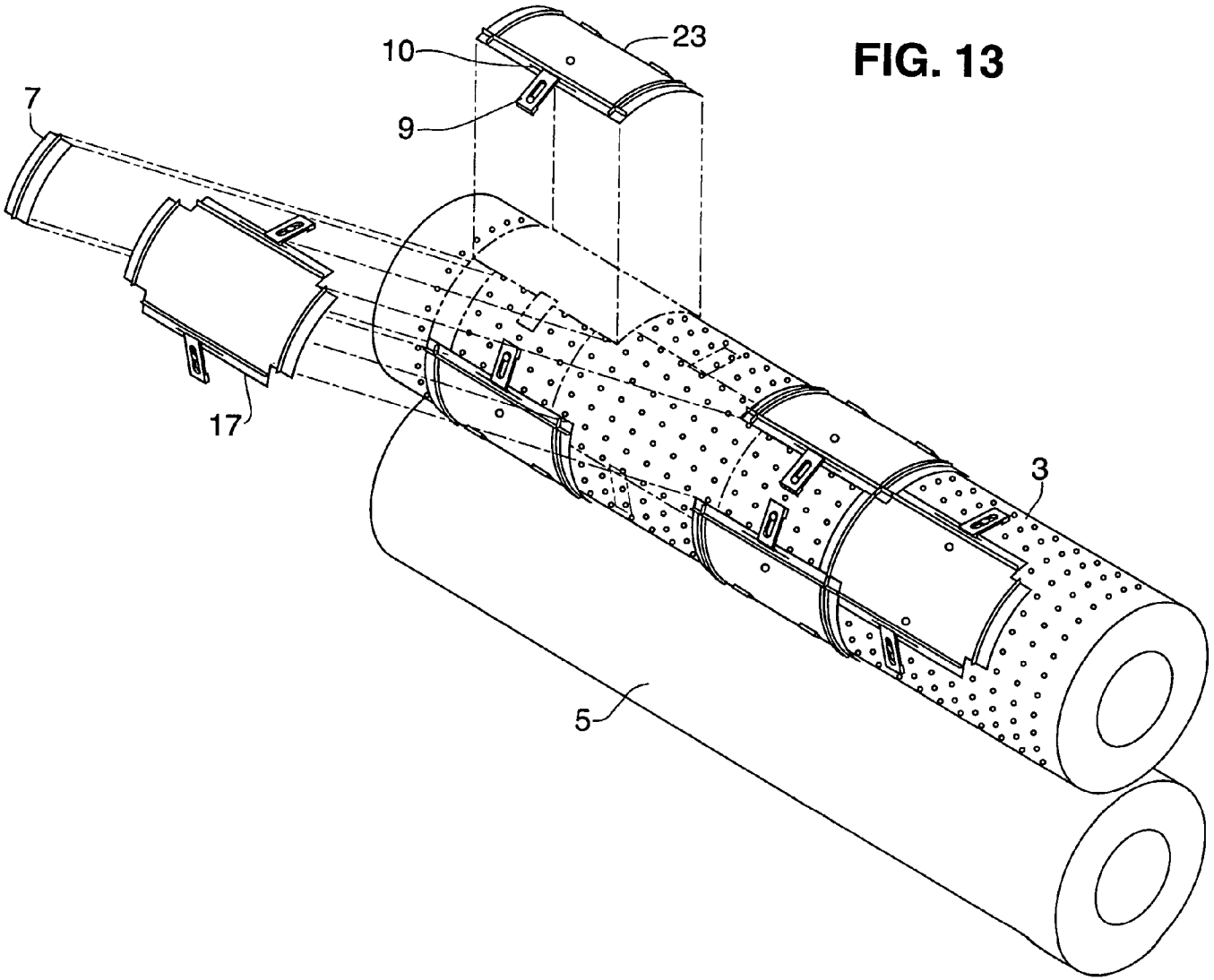
FIG. 13 is a perspective view of a modular/configurable rotary die of a seventh embodiment of the invention wherein seven modular die components can be combined in multiple configurations for multiple box sizes for making carton blanks to make a regular slotted container as shown in FIG. 14B.
Figure 14A:
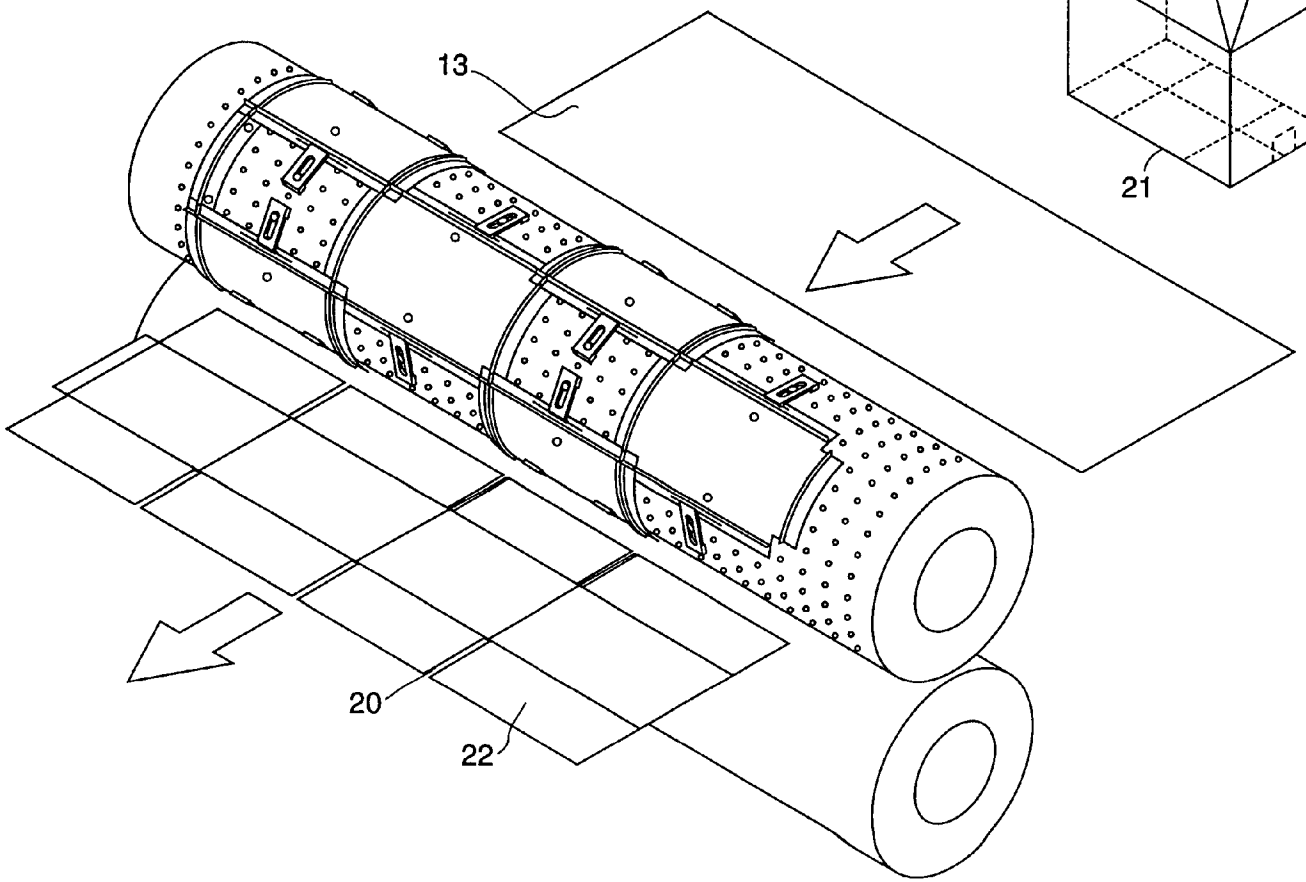
FIG. 14A is a perspective view of the rotary die of FIG. 13 being used for making carton blanks for erecting boxes from corrugated sheets.

To produce an RSC carton blank 22 that is 12 inches long×12 inches long×12 inches wide, these die components are mounted, interlocked and secured on the roller of the rotary die cutter as shown in FIGS. 13 and 14A:

Two (2) score/crease panel die components 17, RL1212 (determines 12-in. length and 12-in. height)

One (1) crease rule die component 7, RH12 (determines 12-in. height)

Four (4) flap die components 23, RFW12 (determines 12-in. width)

Example P4

Regular Slotted Container

To produce an RSC carton blank 22 that is 12 inches long×18 inches high×12 inches wide, these die components are mounted, interlocked and secured on the roller of the rotary die cutter as shown in FIGS. 13 and 14A:

Two (2) score/crease panel die components 17, RL1218 (determines 12-in. length and 18-in. height)

One (1) crease panel die component 7, PH18 (determines 18-in. height)

Four (4) flap die components 23, RFW12 (determines 12-in. width)

The RSC modular die components used in this panel-model approach can be combined in multiple configurations for multiple box sizes using seven die components as indicated in FIGS. 13 and 14A and sixteen clamps. The height/length die components key into/under RSC flap die components 23. This approach involves fewer parts than the rule-model approach and installation is easier. The height/length component is an inexpensive component, although the panel-model approach provides limited flexibility as compared with the rule-model approach.

Figure 9:
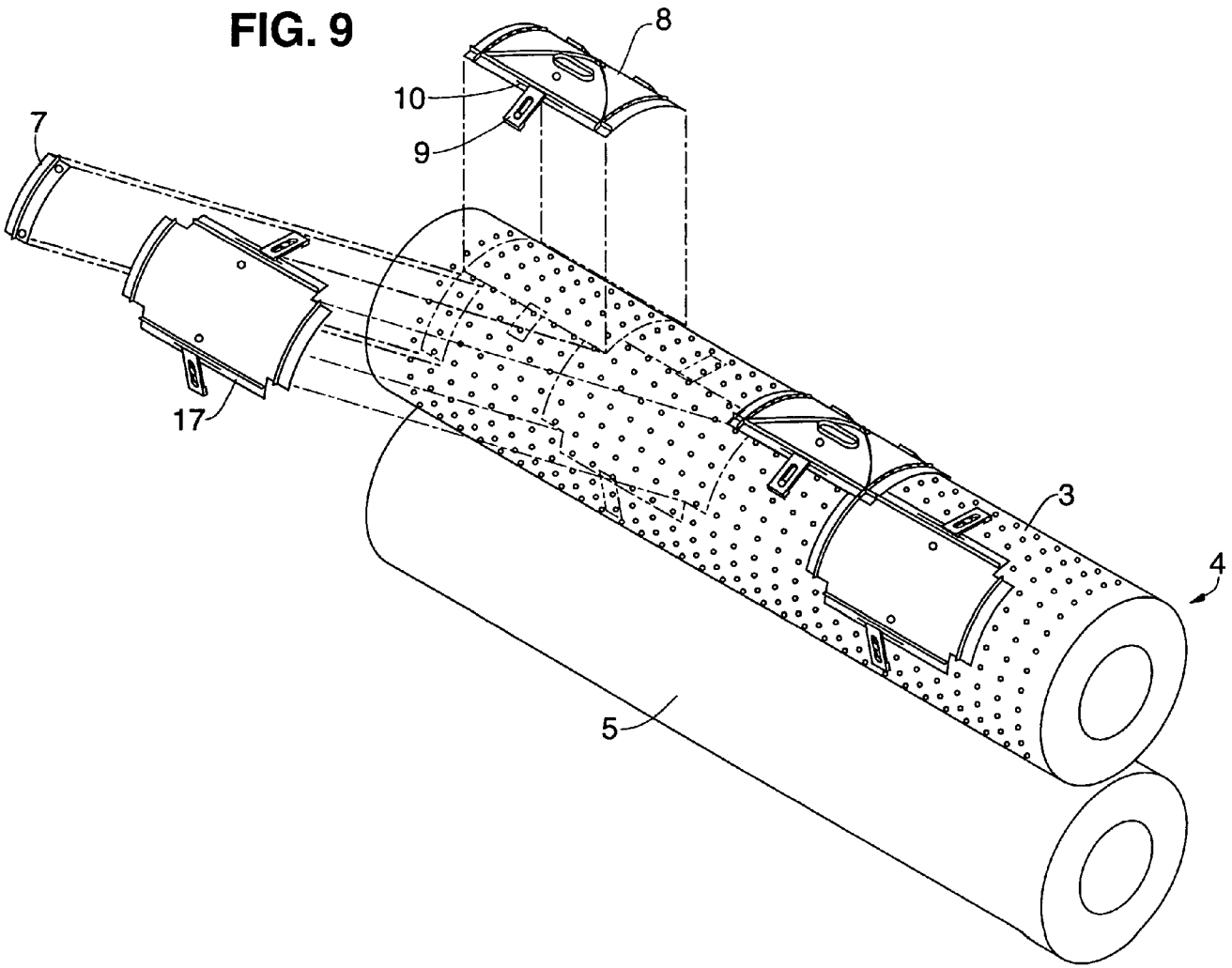
FIG. 9 is a perspective view of a fifth embodiment of a modular/configurable rotary die of the invention comprising five die components which can be combined in multiple configuration for multiple box sizes, for producing a half box which can be telescoped in a complementary half box as shown in FIG. 10B.
Figure 10B:
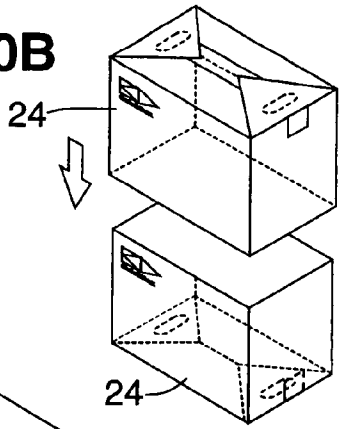
FIG. 10B is a perspective view of two complementary half boxes erected from carton blanks produced using the rotary die and method of FIGS. 9 and 10A.
Figure 10A:
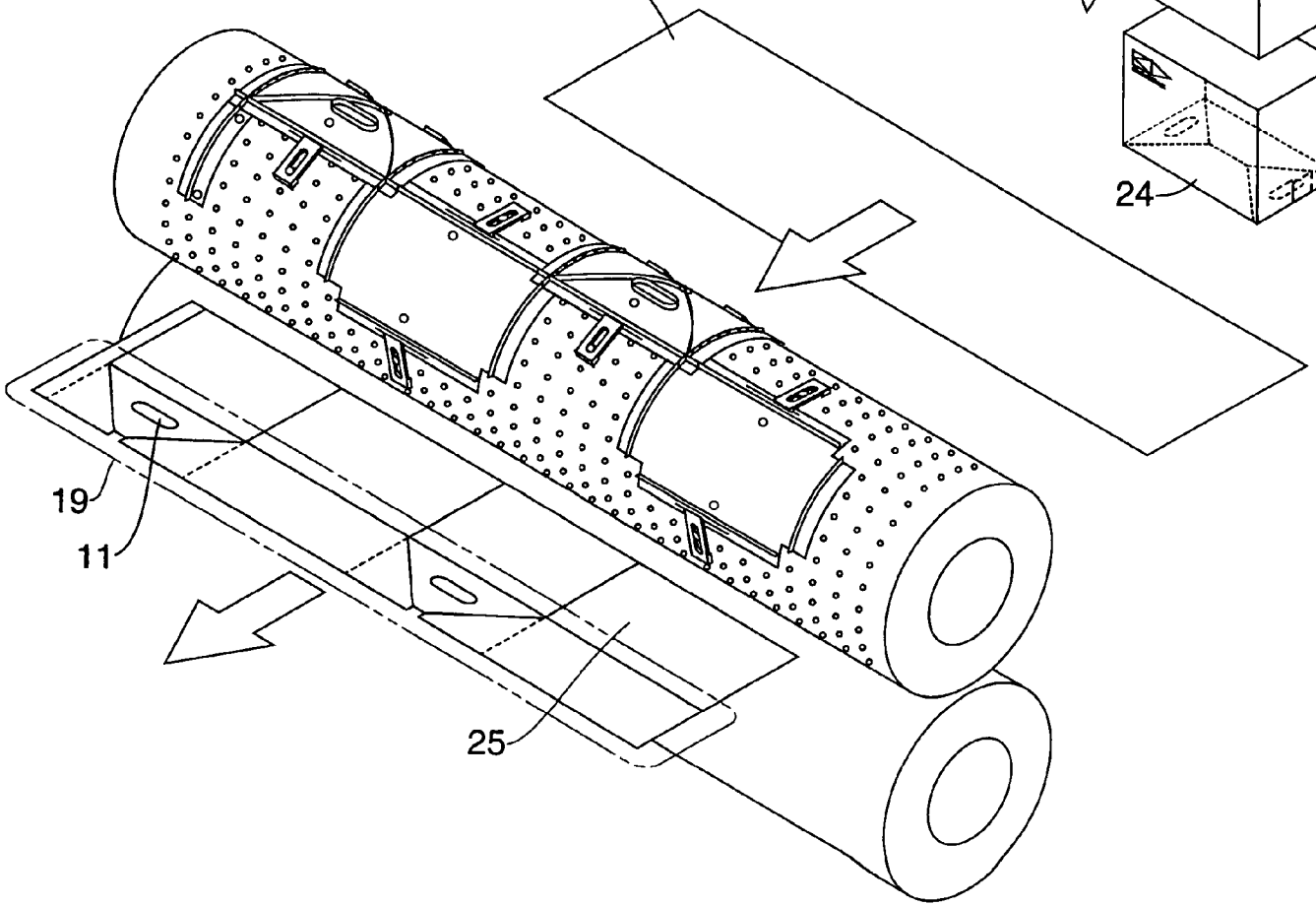
FIG. 10A is a perspective view of the rotary die of FIG. 9 in use for producing a carton blank which can be erected to form a half box employing a quick closable closure panel.

An arrangement of modular die components for producing a telescope half box 24 with a quick closing continuous closure panel 19 from carton blank 25, to be used with a complementary half box, see FIG. 10B, is shown in FIGS. 9 and 10A. Five die components are arranged on the rotary die roller 3, namely:

Two QuickBox closure panel die components 8 which determine box width;

Two score/crease die components 17 which determine box height/length; and

One crease rule die component 7 which determines box height.

The five die components are secured on the die roller 3 using ten die mounting clamps 9 which are received in die mounting clamp slots 10. The height/length die components key into/under the die components 8. With this arrangement there are few parts and installation is easy. The length/height component is inexpensive, although there is limited flexibility. Nevertheless, the modular die components can be combined in multiple configurations for multiple box sizes.

Figure 15:
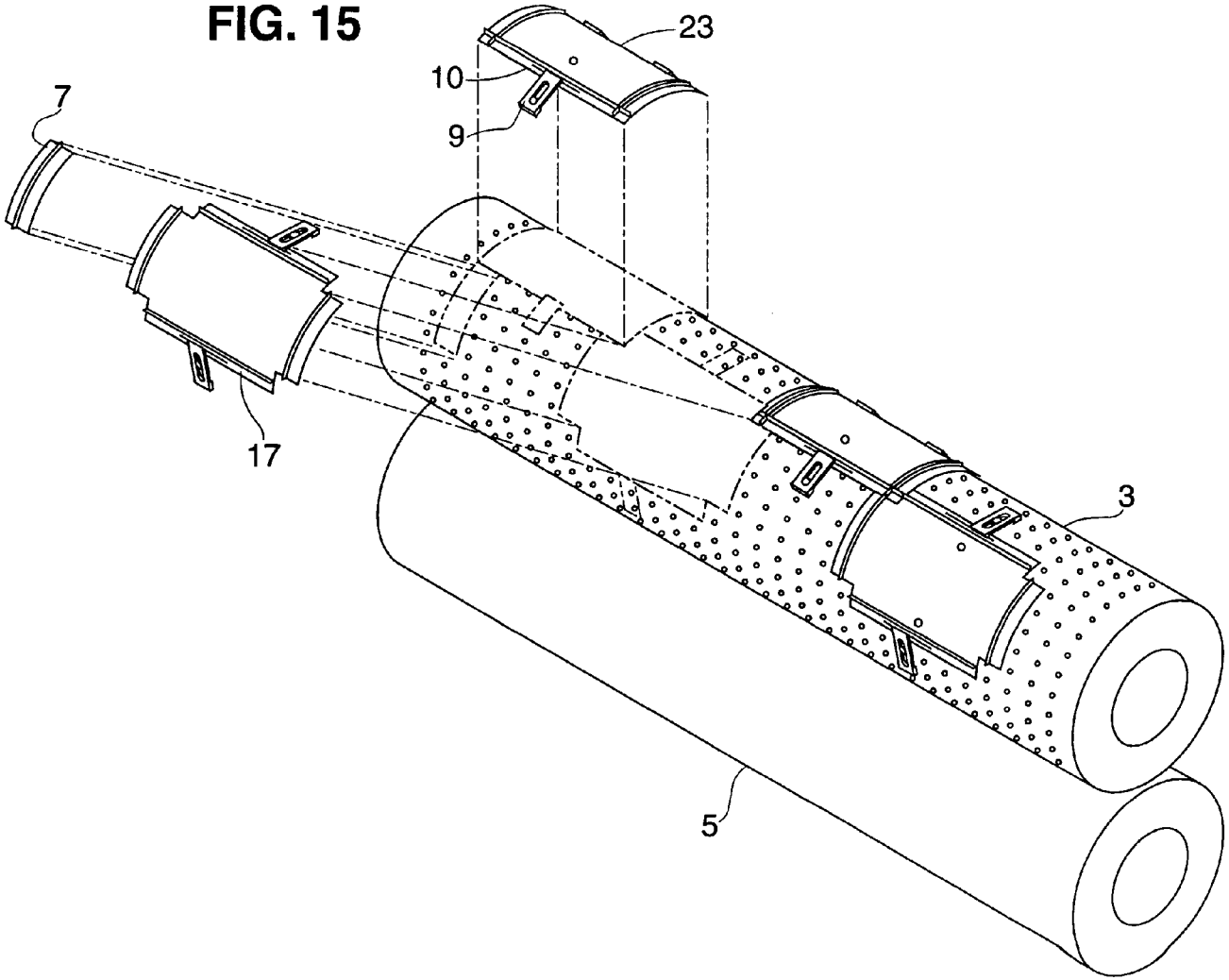
FIG. 15 is a perspective view of a modular/configurable rotary die of an eighth embodiment of the invention comprising five modular die components which can be combined in multiple configurations for multiple box sizes for producing carton blanks for erecting half regular slotted container type boxes which are to be telescoped in a complementary half box as shown in FIG. 16B.
Figure 16B:
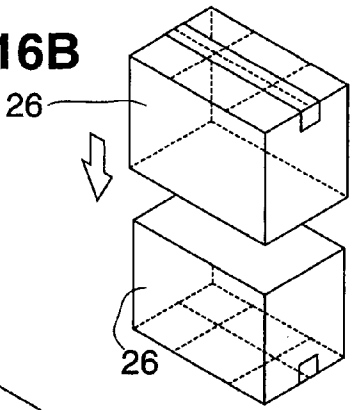
FIG. 16B is a perspective view of a box made using two half boxes produced using the rotary die and method of FIGS. 15 and 16A.
Figure 16A:
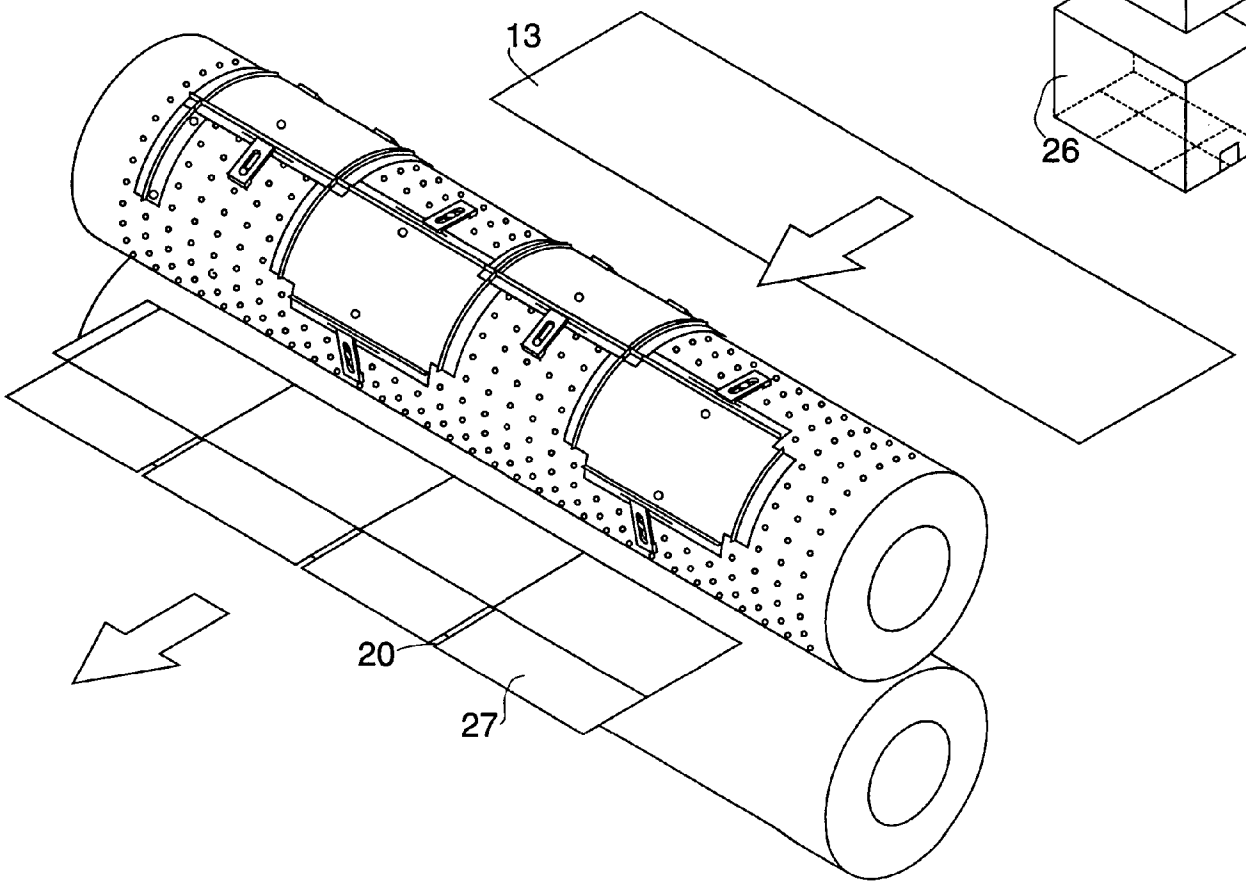
FIG. 16A is a perspective of the rotary die of FIG. 15 in use for making carton blanks for erecting telescoping half regular slotted containers.

Similarly, an arrangement of modular die components for producing a telescope half RSC box 26, FIG. 16B, from carton blank 27 is depicted in FIGS. 15 and 16A. The die components include two RSC flap die components 23 determining box width, two score/crease die components 17 determining box height/length, and one-crease rule die component 7 determining box height. The five die components are held in place on the die roller 3 using ten clamps 10. The height/length die components key into/under the RSC flap die components 23.

Detailed Descriptions of Die Components of the Modular/Configurable Rotary Die

A finished corrugated carton starts out as a stock sheet of corrugated material of a particular width and length. When a die creases, scores, slots, slits or cuts the sheet, the result is carton blank of a particular type and size. When the carton blank is folded and glued at the manufactured joint, it becomes a knocked down flat (KDF), which then can be erected into a carton.

Score Rule Die Component (Length)

This die component scores the sheet to create the folding lines on a carton blank that determine the length of the carton (QuickBox and RSC).

The length of this die component determines the length of the carton.

To produce any type QuickBox or RSC, four (4) of these die components are used per carton blank.

Each die component contains:

One (1) score blade, see for example blade 43 on element 6 in FIG. 1. Each blade scores one of four (4) folding lines on a blank.

This die component is mounted on the roller of the rotary die cutter and secured with the positioning clamp. For QuickBox, the component is interlocked with the QuickBox closure panel die component. For RSC, the component is interlocked with the flap die component.

Creas Rule Die Component (Height)

This die component creases the sheet to create the folding lines on a carton blank that determine the height of the carton (QuickBox or RSC).

The length of this die component determines the height of the carton.

To produce any type QuickBox and RSC, four (4) of these die components are used per carton blank.

Each die component contains:

One (1) crease blade, see crease blade 44 on element 7 in FIG. 1. Each blade creases one of four (4) folding lines on a carton blank.

This die component is mounted on the roller of the rotary die cutter and secured with positioning clamps. For QuickBox, the component is interlocked with the QuickBox closure panel die component. For RSC, the component is interlocked with the flap die component.

Score/Crease Panel Die Component (Length and Height)

This die component is a combination of two score rule die components and two crease rule die components to produce a single die component.

It scores the sheet to create the folding lines on a carton blank that determine the length of the carton (QuickBox and RSC).

It creases the sheet to create the folding lines on a carton blank that determine the height of the carton (QuickBox and RSC).

To produce any type QuickBox and RSC, two (2) of these die components are used per carton blank.

Each die component contains:

Two (2) score blades: Each blade creases one of four (4) folding lines on a carton blank.

Two (2) crease blades: Each blade creases one of four (4) folding lines on a carton blank.

This die component is mounted on the roller of the rotary die cutter and secured with positioning clamps. For QuickBox, the component is interlocked with the QuickBox closure panel die component. For RSC, the component is interlocked with the flap die component.

QuickBox Closure Panel Die Component

A QuickBox carton is preferably made with the QuickBox continuous closure panel as disclosed in commonly owned U.S. Pat. No. 6,467,682.

QuickBox: It has two (2) continuous closure panels 19 that run parallel to each other end-to-end along the length of the carton blank.

There is one (1) top continuous closure panel comprised of two (2) fold-in panels 41 and two (2) top panels 40.

There is one (1) bottom continuous closure panel 19 comprised of two (2) fold-in panels 41 and two (2) bottom panels 40.

QuickBox ✓: It has one (1) continuous closure panel 19 comprised of two (2) fold-in panels 41 and two (2) top panels 40.

The QuickBox closure panel die component creates the fold-in panels on the QuickBox carton blank.

To produce a QuickBox carton blank, four (4) of these die components are required. Each die component contains:

Two slit/cut blades, 45 in FIG. 1 on element 8. Each blade slits a 45-degree angled line on each of the four (4) fold-in panels 41, for a total of eight (8) angled lines per carton blank.

Two (2) perforation blades, 46 in FIG. 2A. Each blade cuts and scores, i.e., perforates, one (1) straight line that is perpendicular to the length of the carton blank; these two (2) lines are parallel to each other. Each pair of lines defines the width of each of the four (4) fold-in panels per carton blank.

One (1) straight scoring blade, 47 in FIG. 2A. This blade scores a straight line at the bottom of the fold-in panel, parallel to the length of the carton blank. Each line is located between the two perforated lines described above, for a total of four (4) lines per carton blank.

One (1) curved cut blade, 48 in FIG. 2A. This blade cuts the outline of the hide away handle 11 on the four (4) fold-in panels of the carton blank.

To produce a QuickBox ✓ carton blank, two (2) of these die components are required.

Two (2) slit/cut blades. Each blade slits a 45-degree angled line on each of the two (2) fold-in panels, for a total of four (4) angled lines per carton blank.

Two (2) perforation blades: Each blade cuts and scores, i.e., perforates, one (1) straight line that is perpendicular to the length of the carton blank; these two (2) lines are parallel to each other. Each pair of lines defines the width of each of the two (2) fold-in panels per carton blank.

One (1) straight scoring blade: This blade scores a straight line at the bottom of the fold-in panel, parallel to the length of the carton blank. Each line is located between the two perforated lines described above, for a total of two (2) lines per carton blank.

One (1) curved cut blade: This blade cuts the outline of the hideaway handle on the two fold-in panels per carton blank.

Flap Die Component

This die component cuts slots on a carton blank to create the flaps of a QuickBox ✓ and an RSC.

To produce a QuickBox ✓ two (2) of these die components are required for the RSC part of the box, e.g., the bottom of the box. Each die component contains:

Four (4) cut blades: The four blades are grouped into two (2) pairs. Each pair cuts out two (2) slots for a total of four (4) slots on a carton blank.

One (1) straight scoring blade: This blade scores a straight line at the bottom of the flap, parallel to the length of the carton blank. Each line is located between the two (2) pairs of blades described above, for a total of two (2) lines per carton blank.

To produce an RSC, four (4) of these die components are mounted on the roller of the rotary die cutter. Each die component contains:

Four (4) cut blades: The four blades are grouped into two (2) pairs. Each pair cuts out two (2) slots for a total of eight (8) slots on a carton blank.

One (1) straight scoring blade: This blade scores a straight line at the bottom of the flap, parallel to the length of the carton blank. Each line is located between the two (2) pairs of blades described above, for a total of four (4) lines per carton blank.

Die Mounting Clamp

Conventionally, in order to mount a die on the roller of a rotary die cutter, threaded-attachment holes on the die are pre-determined and fixed so that they match the exact hole-pattern of an industry-standard roller.

By contrast, the die mounting clamp 9 of the invention enables a single die component—or a fully assembled die comprised of various die components that are interlocked together—to be mounted and secured on a roller regardless of the threaded-hole pattern. The die mounting clamp can utilize a roller's existing, standard, threaded, mounting hole pattern. This capability provides flexibility in mounting and securing dies that is not currently possible in the corrugated carton industry.

Below is a description of mounting and securing a die component, or an assembled die, to a roller utilizing die mounting clamps:

Step 1 Assembling a Die

Figure 18E:
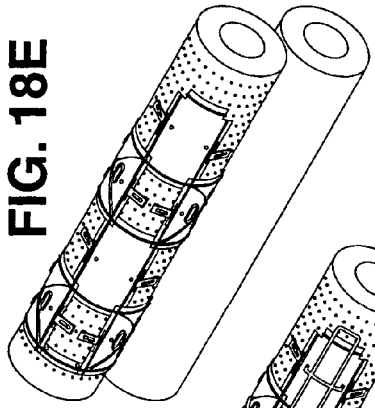
Figure 18D:
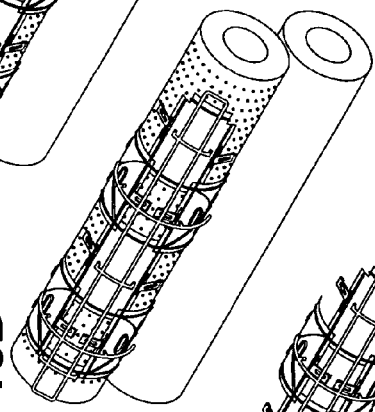
Figure 18C:
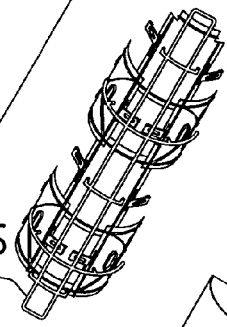
Figure 18F:
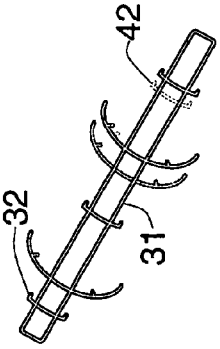
Figure 18B:
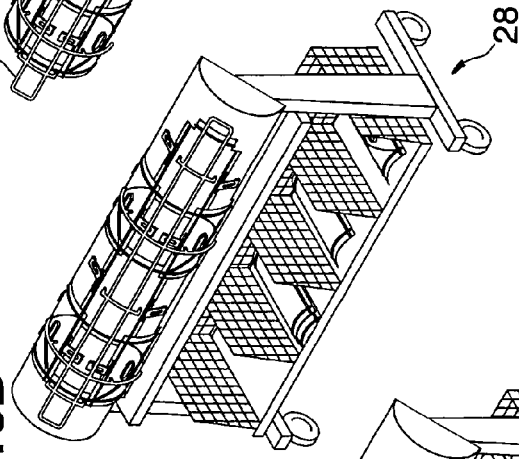
Figure 18A:
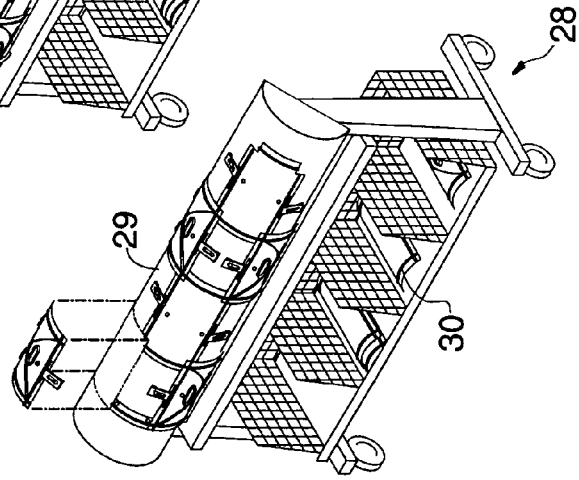

Approach A:

1 At a workstation, 28 in FIGS. 18A and 18B, the die is pre-assembled by interlocking various die components together on a curved assembly surface 29. The die components are stored in a storage 30 in the workstation.

2 The pre-assembled die is positioned on the roller using a brace 31 with quick couplings 32, FIGS. 18B, 18C, 18D and 18F; its position is secured by mounting the die on the roller utilizing die mounting clamps (see Step 2 below and FIGS. 18D and 18E).

Approach B:

1 A single die component is positioned anywhere on the roller.

2 Completion of the die assembly is achieved by interlocking the remaining die components together while they are on the roller.

3 The assembled die is positioned on the roller; its position is secured by mounting the die on the roller utilizing die mounting clamps (see Step 2 below).

Step 2 Securing the Die's Position on the Roller

After the fully assembled die has been positioned on the roller using Approach A or B, the die must be secured in that position with one or more die mounting clamp(s) so that the die correctly aligns with sheets of corrugated material as material is fed between the rollers.

Securing the die in position is achieved as described here:

Each die component has a groove or slot 10 into which a die mounting clamp is inserted. Each die mounting clamp has a slot with a screw; this screw secures the die mounting clamp and die assembly to the roller.

The die mounting clamp slides laterally right or left on the surface of the roller along the roller's existing hole-pattern line. Concurrently, the die mounting clamp screws can slide around the circumference of the roller.

These concurrent movements of the die mounting clamp are to locate the hole(s) along the roller's hole-pattern line into which the clamp can be screwed to the roller.

When the correct hole(s) has been located, the screw(s) on the die mounting clamp(s) are threaded into the hole(s) and tightened.

Varying quantities of die mounting clamps are utilized to secure the die component and/or assembled die, depending on the type and size of the die being mounted to a roller.

From the above, it can be seen that the modular die components of the rotary die cutter of the invention can be combined in multiple configurations. The work station 28 and brace 31 allow assembly of modular die components for quick change over of box sizes. The brace allows adjustable quick coupling alignments to modular die components. As indicated by arrows at 42 in FIG. 18F, all coupling positions of quick couplings 32 on brace 31 are adjustable.

By way of explanation, when regular slotted containers (RSCs) are open, i.e., before the flaps are folded over and sealed shut to close the carton, people often pick up and move an RSC with the flaps. Two of the four flaps are folded over to the outside of the carton so that the top edges of the flaps point downward. When the flaps are in this position, they act as handles for the carton. The QuickBox continuous closure panel 19 is one (1) continuous piece; therefore, it cannot be folded backwards to act as a handle for the open carton.

The hide away handle 11 of the invention addresses the need to pickup and move an open QuickBox.

The hide away handle is cut into the QuickBox continuous closure panel:

One (1) curved cut blade: This blade, 48 in FIG. 2A, cuts the outline of the hide away handle on the fold-in panel. A QuickBox contains four (4) fold-in panels; a QuickBox ✓ (container with QuickBox top and RSC bottom), contains two (2) fold-in panels.

The curved cut blade is located between the two (2) slit/cut blades and the straight scoring blade as noted above.

When a person inserts his/her hand into the cut outline of the hide away handle on the open QuickBox continuous closure panel, the corrugated material opens; this opening provides a handle so that the QuickBox can be picked up and moved.

When the QuickBox continuous closure panel is folded over, thereby closing the QuickBox, the hide away handle no longer is accessible.

The present invention is thus seen to provide an improved rotary die cutter which includes a modular/configurable die for the roller of the rotary press of the rotary die cutter equipment for producing varying types and sizes of corrugated carton blanks thus eliminating the need for a dedicated die for each specific type/size blank. Although the invention has been described with reference to preferred embodiments, rearrangement, alterations, and substitutions can be made, and still the result will be within the scope of the invention.

I claim:

1. A modular/configurable rotary die for a rotary die cutter for making a corrugated carton blank, from which a carton having at least one quick closing continuous closure panel can be erected, from a stock sheet of corrugated material, the rotary die comprising:

a plurality of at least five interlocking modular die components which are capable of being combined in multiple configurations for producing multiple carton sizes, said die components being mountable directly on a roller of a rotary die cutter, the roller having a threaded hole pattern, where the die components are interlocked with one another, each die component having at least one blade thereon for at least one of scoring, creasing and cutting a corrugated sheet to cooperatively form a corrugated carton blank in a rotary die cutter from a stock sheet of corrugated material, a plurality of adjustable die mounting clamps having means for securing the die components anywhere on the roller of the rotary die cutter regardless of the threaded hole pattern, wherein said plurality of die components include, with reference to the three dimensions of the carton to be erected from the corrugated carton blank, at least one length die component which determines the length of the carton, at least one height die component which determines the height of the carton, and at least two closure panel die components which determine the width of the carton and produce respective fold-in panels of said at least one quick closing continuous closure panel, wherein each of said closure panel die components includes:

two slit/cut blades each arranged for slitting a 45 degree angled line on a fold-in panel of a quick closing continuous closure panel, two perforation blades each arranged to cut and score the corrugated stock sheet to form a perforated straight line that is perpendicular to the length of the carton blank, and one scoring blade arranged to score a straight line at the bottom of the fold-in panel, parallel to the length of the carton blank and between the two perforated lines formed by said two perforation blades.

2. The rotary die according to claim 1, wherein said means for securing of the adjustable die mounting clamps include slots with screws in the clamps for threading into threaded holes in the roller of a rotary die cutter.

3. The rotary die according to claim 1, wherein said plurality of die components include components having slots on their outer surfaces for receiving said adjustable die mounting clamps therein for securing the die components on the roller of the rotary die cutter.

4. The rotary die according to claim 1, wherein said plurality of die components include four of said closure panel die components which determine the width of the carton and cooperate to form a corrugated carton blank having two quick closing continuous closure panels that run parallel to each other end-to-end along the length of the carton blank on respective sides of the carton blank.

5. The rotary die according to claim 4, wherein said plurality of die components further include:

(a) four score die components that determine the length of a carton to be erected from the corrugated carton blank; and (b) four crease die components that determine the height of the carton.

6. The rotary die according to claim 4, wherein said plurality of die components further include:

(a) two score/crease panel die components that determine the height and the length of a carton to be erected from the corrugated carton blank; and (b) one crease die component that determines the height of the carton.

7. The rotary die according to claim 4, wherein each of said closure panel die components further includes a curved cut blade that cuts the outline of a hide away handle on a fold-in panel of a quick closing closure panel formed on the corrugated carton blank.

8. The rotary die according to claim 1, wherein said plurality of die components cooperate to form a corrugated carton blank having one quick closing continuous closure panel that runs along the length of the carton blank on one side thereof and on an opposite side has a plurality of flaps with cut slots separating the flaps.

9. The rotary die according to claim 8, wherein said plurality of die components further include:

(a) four score die components that determine the length of a carton to be erected from the corrugated carton blank;

(b) four crease die components that determine the height of the carton; and (c) two flap die components that determine the width of the carton and cut the slots for the flaps.

10. The rotary die according to claim 8, wherein said plurality of die components further include:

(a) two score/crease panel die components which determine the height and the length of a carton to be erected from the corrugated carton blank;

(b) one crease die component that determines the height of the carton; and (c) two flap die components that determine the width of the carton and cut the slots for the flaps.

11. The rotary die according to claim 8, wherein each of said closure panel die components further includes a curved cut blade that cuts the outline of a hide away handle on a fold in panel of a quick closing closure panel formed on the corrugated carton blank.

12. The rotary die according to claim 1, wherein said plurality of die components cooperate to form a corrugated carton blank having one quick closing continuous closure panel that runs along the length of the carton blank on one side thereof, which carton blank can be erected to form a telescope half carton.

13. The rotary die according to claim 12, wherein said plurality of die components further include:

(a) two score/crease die components that determine the height and the length of the carton to be erected from the corrugated carton blank; and (b) one crease die component that determines the height of the carton.

14. The rotary die according to claim 1, wherein said plurality of die components are pre-assembled in interlocking relation with one another on a brace for positioning the pre-assembled die components on a roller of a rotary die cuter.

15. The rotary die according to claim 1, wherein said plurality of die components are secured in position on a roller of a rotary die cutter.

16. A rotary die cutter for making a corrugated carton blank, from which a carton having at least one quick closing continuous closure panel can be erected, from a stock sheet of corrugated material, comprising:

a rotary die anvil roller;

a rotary die roller having a threaded hole pattern;

a rotary die mounted on the outer circumferential surface of the rotary die roller to form a rotary press with said rotary die anvil roller for producing a corrugated carton blank from a stock sheet of corrugated material fed between the rotary die and the anvil roller;

wherein the rotary die is formed with a plurality of at least five interlocking modular die components which are capable of being combined in multiple configurations for producing multiple carton sizes, said die components being mounted directly on said rotary die roller and interlocked with one another, each die component having at least one blade thereon for at least one of scoring, creasing and cutting a corrugated sheet fed between the rotary die and the anvil roller to cooperatively form a corrugated carton blank from a stock sheet of corrugated material, a plurality of adjustable die mounting clamps having means for securing the die components anywhere on the roller of the rotary die cutter regardless of the threaded hole pattern, wherein said plurality of die components include, with reference to the three dimensions of a carton to be erected from a corrugated carton blank, at least one length die component which determines the length of the carton, at least one height die component which determines the height of the carton, and at least two closure panel die components which determine the width of the carton and produce respective fold-in panels of said at least one quick closing continuous closure panel, wherein each of said closure panel die components includes:

two slit/cut blades each arranged for slitting a 45 degree angled line on a fold-in panel of a quick closing continuous closure panel, two perforation blades each arranged to cut and score the corrugated stock sheet to form a perforated straight line that is perpendicular to the length of the carton blank, and one scoring blade arranged to score a straight line at the bottom of the fold-in panel, parallel to the length of the carton blank and between the two perforated lines formed by said two perforation blades.

17. The rotary die cutter according to claim 16, wherein said at least one quick closing continuous closure panel formed by said die components runs end-to-end along the length of the carton blank.

18. The rotary die cutter according to claim 16, wherein the at least two closure panel die components each have a curved cut blade that cuts the outline of a hide away handle on fold-in panels formed on the carton blank.

19. The rotary die cutter according to claim 16, wherein said means for securing of the adjustable die mounting clamps include slots with screws in the clamps for threading into threaded holes in the roller of the rotary die cutter.

20. The rotary die cutter according to claim 16, wherein said plurality of die components include components having slots on their outer surfaces for receiving said adjustable die mounting clamps therein for securing the die components on the roller of the rotary die cutter.

* * * * *